United States Patent [19]

Szarka

[11] Patent Number: 4,627,488

[45] Date of Patent: Dec. 9, 1986

[54] ISOLATION GRAVEL PACKER

[75] Inventor: David D. Szarka, Duncan, Okla.

[73] Assignee: Halliburton Company, Duncan, Okla.

[21] Appl. No.: 703,630

[22] Filed: Feb. 20, 1985

[51] Int. Cl.[4] ..... E21B 43/04

[52] U.S. Cl. ..... 166/51; 166/142; 166/278

[58] Field of Search ..... 166/51, 142, 146, 149, 166/184, 185, 191, 278

[56] References Cited

U.S. PATENT DOCUMENTS

| | | | |
|---|---|---|---|
| 2,210,245 | 8/1940 | Kimmel | 166/146 |
| 2,894,588 | 7/1959 | Tausch et al. | 166/184 |
| 3,710,862 | 1/1973 | Young et al. | 166/278 |
| 4,270,608 | 6/1981 | Hendrickson et al. | 166/278 |
| 4,270,610 | 6/1981 | Barrington | 166/317 |
| 4,273,190 | 6/1981 | Baker et al. | 166/278 |
| 4,295,524 | 10/1981 | Baker et al. | 166/278 |
| 4,296,807 | 10/1981 | Hendrickson et al. | 166/184 |
| 4,369,840 | 1/1983 | Szarka et al. | 166/214 |
| 4,401,158 | 8/1983 | Spencer et al. | 166/51 |
| 4,428,428 | 1/1984 | Smyrl et al. | 166/51 X |
| 4,429,748 | 2/1984 | Beck | 166/324 |
| 4,438,933 | 3/1984 | Zimmerman | 166/278 X |
| 4,474,239 | 10/1984 | Colomb et al. | 166/278 |
| 4,583,593 | 4/1986 | Zunkel et al. | 166/51 X |

OTHER PUBLICATIONS

Exhibit "A"-Baker Sand Control brochure entitled, Baker Sand Control—Sand Control Technology—High Density Gravel Pack.

*Primary Examiner*—Stephen J. Novosad
*Assistant Examiner*—John F. Letchford
*Attorney, Agent, or Firm*—James R. Duzan

[57] ABSTRACT

An isolation gravel packer includes a housing which has a stinger receptacle disposed therein. The stinger receptacle has an open upper end and an inner cylindrical seal bore. The inner cylindrical seal bore sealingly receives a concentric inner tubing string therein for delivering a treatment fluid thereto. A treatment fluid passage is disposed laterally through the housing for communicating an interior of the stinger receptacle at an elevation below the seal bore with the well zone to be treated. First and second external seals are disposed on an exterior of the housing above and below the treatment fluid passage, respectively, for sealing between the housing and a liner bore. The housing also includes a combination bypass passage and return fluid passage disposed therein which is isolated from the treatment fluid passage. Treatment fluid is flowed from a surface location down through the concentric inner tubing string, then through the treatment fluid passage to the well zone. Return fluid flows from the well zone upward through the combination bypass passage and return fluid passage, then through an annulus between an outer tubing string and the concentric inner tubing string to the surface location.

19 Claims, 28 Drawing Figures

ISOLATION GRAVEL PACKER

BACKGROUND OF THE INVENTION

1. Field of the Invention

This invention relates generally to systems for gravel-packing one or more production zones of a well, and more particularly, to an isolation gravel packer for use in such a system.

2. Description of the Prior Art

Unconsolidated formations, particularly those containing loose sands and sandstone strata, present constant problems in well production due to migration of loose sands and degraded sandstone into the well bore as the formation deteriorates under the pressure and flow of fluids therethrough. This migration of particles may eventually clog the flow passages in the production system of the well, and can seriously erode the equipment. In some instances, the clogging of the production system may lead to a complete cessation of flow, or killing of the well.

One method of controlling sand migration into a well bore consists of placing a pack of gravel on the exterior of a perforated or slotted liner or screen which is positioned across an unconsolidated formation to present a barrier to the migrating sand from that formation while still permitting fluid flow. The gravel is carried to the formation in the form of a slurry, the carrier fluid being removed and returned to the surface. The proper size of gravel must be employed to effectively halt sand migration through the pack, the apertures of the liner or screen being gauged so that the gravel will settle out on its exterior, with the slurry fluid carrying the gravel entering the liner or screen from its exterior and being circulated back to the surface.

Prior to effecting the gravel pack, drilling mud and other contaminants may be washed from the well bore, and the formation treated. Commonly employed treatments include acidizing to dissolve formation clays, and injecting stabilizing gels to prevent migration of formation components and formation breakdown prior to packing.

Subsequent to effecting the gravel pack, a reverse-circulation technique may be utilized to remove remaining gravel laden slurry from the operating string utilized to conduct the slurry. With such a reverse-circulation technique, the direction of circulation is reversed and a clean fluid is pumped down the path previously utilized for returning the slurry fluid, and the remaining gravel laden slurry will be forced back up the path originally used to conduct the gravel laden slurry down to the well.

One such prior art system previously used by the assignee of the present invention is disclosed in U.S. Pat. No. 4,273,190 to Baker et al.; U.S. Pat. No. 4,295,524 to Baker et al.; U.S. Pat. No. 4,270,608 to Hendrickson et al.; U.S. Pat. No. 4,369,840 to Szarka et al.; and U.S. Pat. No. 4,296,807 to Hendrickson et al., all assigned to the assignee of the present invention and all hereby incorporated herein by reference. In the system illustrated in the above-referenced patents a liner string is first lowered into the well on a string of drill pipe and set in place in the well. Then, the drill string is disconnected from the liner string and retrieved from the well, and subsequently an operating string of gravel-packing tools is lowered into the well and concentrically into the liner string in order to perform the gravel-packing operation in cooperation with the liner string. Thus, this prior system used by the assignee of the present invention requires two trips of the drill string into the well to perform the gravel-packing operation.

The system previously used by the assignee of the present invention as generally described in the five references listed above itself includes an isolation gravel packer similar in a number of respects to that of the present invention. That isolation gravel packer is shown and described in detail in the Baker et al. U.S. Pat. No. 4,295,524 reference.

Another prior art system which is designed to accomplish such a gravel-packing operation with only a single trip of the operating string and liner string into the well is shown in U.S. Pat. No. 4,401,158 to Spencer et al. There are, however, several disadvantages of the Spencer et al. system. First, in order to set the liner hanger of the liner string, it is necessary to drop a ball down through the tubing string to seat on an annular seat contained in a liner hanger setting tool of the operating string. It is often difficult, if not impossible, to seat such a ball, if the well bore hole is highly deviated from the vertical. Also, such free-fall or pump-down balls may have to be reverse-circulated out of the well, which is time consuming and again very difficult in highly deviated holes. A second disadvantage of the Spencer et al. system is that return fluid is allowed to flow past screens immediately adjacent unconsolidated zones of the well, as it flows upward through the liner string, and further, this return fluid after it reaches the upper end of the liner string is returned through the well annulus between the operating string and the well casing. Furthermore, when reverse-circulating with the Spencer et al. system, significant amounts of gravel laden slurry may be left in the operating string.

The Spencer et al. U.S. Pat. No. 4,401,158 reference discussed above includes an isolation gravel packing device as seen in FIGS. 2a–2b thereof which has a gravel-packing port 261 located between upper seals 270 and lower seals 255.

Another prior system for gravel-packing a zone of a well which provides for running the operating string and the liner string into the well together and subsequently performing the gravel-packing operation with only a single trip of the operating string into the well is shown in U.S. Pat. No. 3,710,862 to Young et al.

Thus, while the prior art does include a number of gravel-packing systems, some of which are suitable for gravel-packing multiple zones of a well, and some of which are also suitable for gravel-packing a well with only a single trip of the operating string and liner string into the well, there is still a need for a gravel-packing system suitable for gravel-packing multiple zones of a well with only a single trip of the operating string and liner string into the well, and doing so in a reliable manner.

SUMMARY OF THE INVENTION

The present invention provides a system for gravel-packing a plurality of spaced zones in a well with only a single trip of an operating string and a liner string into the well. This system includes an isolation gravel packer of improved design. The isolation gravel packer includes a housing, and a stinger receptacle disposed in the housing.

The stinger receptacle includes an open lower end and an inner cylindrical seal bore for sealing receiving a concentric inner tubing string for delivering a treatment fluid.

Also included in the stinger receptacle is a treatment fluid passage means disposed laterally through the housing means for communicating an interior of the stinger receptacle at an elevation below the seal bore with a well zone which is to be treated. First and second external seal means are disposed on the exterior of the housing of the stinger receptacle above and below the treatment fluid passage means, respectively, for sealing between the housing means and a liner bore.

Also disposed in the housing means is a combination bypass passage and return fluid passage means, which is isolated from the treatment fluid passage means.

With this system, a concentric inner tubing string can be stabbed into the stinger receptacle for flowing a gravel laden slurry or other well treatment fluid from a surface location down through the concentric inner tubing string, then through the treatment fluid passage means to the well zone.

A return fluid flows from the well zone through the return fluid passage means of the isolation gravel packer, then up through an annulus between an outer tubing string and the concentric inner tubing string to the surface location.

Numerous objects, features and advantages of the present invention will be readily apparent to those skilled in the art upon a reading of the following disclosure when taken in conjunction with the accompanying drawings.

DETAILED DESCRIPTION OF THE PREFERRED EMBODIMENT

General Overall Description of the System

Figure 1A:
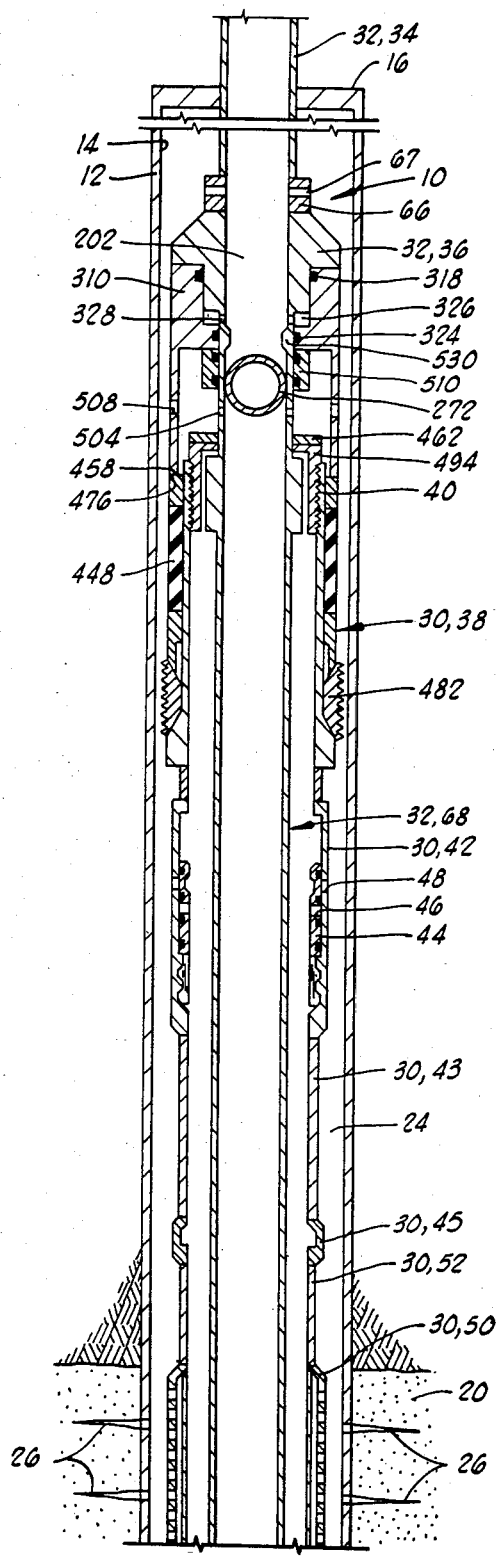
FIGS. 1A–1B comprise a schematic elevation sectioned view of a well showing the gravel-packing system of the present invention as it is being run into the well.
Figure 1B:
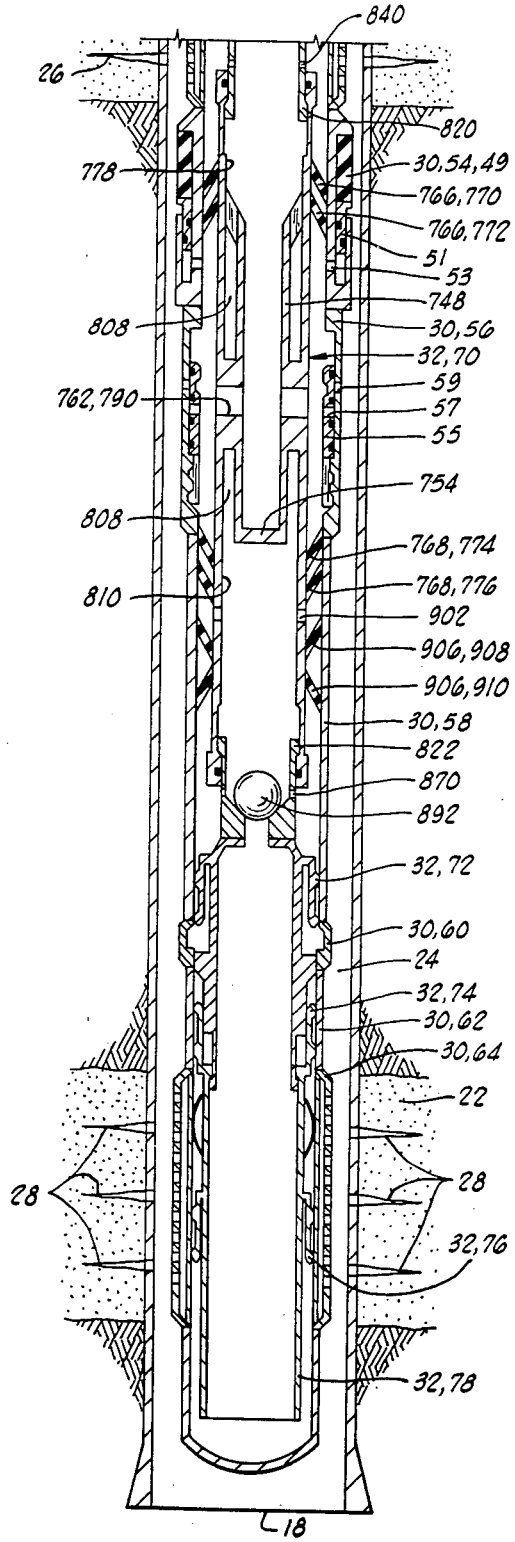

Referring now to the drawings, and particularly to FIGS. 1A–1B, the gravel-packing system of the present invention is shown and generally designated by the numeral 10.

The system 10 is shown in place within a well defined by a well casing 12 having a well bore 14. Although the present disclosure is described with regard to a cased well, it will be understood that the system 10 can also be used in an uncased well.

The well casing 12 extends from an upper end 16 which may also be referred to as a surface location 16 to a lower end 18 which defines the bottom of the well.

The well casing intersects first and second subsurface formations 20 and 22, respectively, which are to be gravel-packed.

The first formation 20 is communicated with a well annulus 24 by a plurality of perforations 26 which extend through the well casing 12 and into the subsurface formation 20.

Similarly, a plurality of perforations 28 communicate the well annulus 24 with the second formation 22.

The gravel-packing system 10 includes a liner string generally designated by the numeral 30, and an operating string generally designated by the numeral 32.

The operating string 32 includes an outer drill pipe string 34 to the lower end of which is connected a liner hanger setting tool 36. The outer string 34 is made up from what is commonly referred to as drill pipe. The outer string may also be generally referred to herein as an outer pipe string 34 or an outer tubing string 34, it being understood that either of these terms includes any hollow cylindrical conduit of sufficient size and strength to accomplish the function described herein.

The liner string 30 includes at its upper end a liner hanger means 38 which is detachably connected to the liner hanger setting tool 36 at threaded connection 40.

Beginning at its upper end with the liner hanger means 38, the liner string 30 includes a plurality of sets of like components, one such set corresponding to each of the subsurface zones to be gravel-packed.

A first selectively openable sleeve valve means 42 is connected in liner string 30 below liner hanger means 38. The sleeve valve means 42 includes a selectively engageable sliding sleeve member 44. The sleeve valve means 42 includes a port 46 which may be aligned with a second port 48 as seen, for example, in FIG. 4A, so that gravel laden slurry can be directed to the well annulus 24 in a manner which will be further described below. A more detailed description of the construction and operation of sleeve valve means 42 is found in U.S. Pat. No. 4,273,190 to Baker et al. with regard to the "full open gravel collar 60" thereof as described beginning at column 6, line 27 thereof.

Connected in liner string 30 below the first sleeve valve means 42 is a first polished bore receptacle 43, and below it is located a first anchor sub 45. The details of construction of the anchor sub 45 may be found in U.S. Pat. No. 4,369,840 to Szarka et al.

A first production screen means 50 of liner string 30 is spaced below first anchor sub 45 by a length of tubing 52.

The first production screen means 50 is located adjacent the first subsurface production zone 20 which is to be gravel-packed.

Liner string 30 includes a first zone isolation packer 54 located below first production screen means 50, for sealing the well annulus 24 below the first production zone 20 in a manner which will be further described below.

The zone isolation packer 54 is preferably constructed in a manner similar to that shown in U.S. Pat. No. 4,438,933 to Zimmerman, with the possible substitution of elastomeric packing elements for the metallic mesh packing high temperature elements suitable for high temperature wells illustrated in the Zimmerman patent. Zone isolation packer 54 has an inflation port 53 communicated with a lower end of a compression piston 51 which moves upward and longitudinally compresses thus radially expanding a sealing element 49.

Those elements of liner string 30 from the liner hanger means 38 down through the first production screen means 50 are all associated with the first production zone 20 which is to be gravel-packed. The liner hanger means 38 also functions as a packer to seal the well annulus 24 above the first production zone 20.

The first zone isolation packer 54 seals the well annulus 24 between the first and second production zones 20 and 22.

The components of liner string 30 below the first zone isolation packer 54 substantially duplicate those components of the liner string 30 between the liner hanger means 38 and the first zone isolation packer 54.

Thus, liner string 30 includes a second sleeve valve means 56, a second polished bore receptacle 58, a second anchor sub 60, a second spacer tubing 62, and a second production screen means 64.

The second sleeve valve means 56 includes a sliding sleeve member 55 having a port 57 disposed therethrough which can be aligned with port 59 to define the open position of the second sleeve valve means 56.

The operating string 32 includes the outer tubing string 34 and the liner hanger setting tool 36 previously mentioned.

Located in the operating string 32 immediately above the liner hanger setting tool 36 is a fill-up valve means 66 for allowing well fluid to fill up the outer tubing string 34 as the operating string 32 is lowered into the well. The fill-up valve means 66 is a commercially available device which includes a sleeve type valve operable in response to a pressure differential between the well annulus 24 and an enclosed low pressure air-filled chamber of the fill-up valve means 66. The open position of fill-up valve 66 is represented schematically in FIG. 1A through the illustration of an open port 67 disposed therethrough. In the remaining figures, the open port 67 is not shown, thus designating that the fill-up valve means 66 is in a closed position.

Operating string 32 includes a length of spacer tubing 68 located below liner hanger setting tool 36.

An isolation gravel packer 70 is located in operating string 32 at the lower end of spacer tubing 68.

Below the isolation gravel packer 70, the operating string 32 includes an opening positioner 72, an anchor positioner 74, a closing positioner 76, and a tail pipe 78.

The details of construction of the opening positioner 72, anchor positioner 74, and closing positioner 76, and their operable relationship with the anchor sub 60 and with the sleeve valve means 42 and 56 is described in considerably further detail in U.S. Pat. No. 4,369,840 to Szarka et al. and U.S. Pat. No. 4,273,190 to Baker et al.

Details of Construction of the Liner Hanger Setting Tool and Liner Hanger Means Referring now to FIGS. 7A–7E, a more detailed sectioned elevation view is thereshown of the liner hanger setting tool 36 which may also be more generally referred to as a liner setting apparatus or a conduit setting apparatus 36.

The liner hanger setting tool 36 includes a housing 200 having a housing bore 202 disposed therethrough.

The housing 200 is comprised of a plurality of interconnected members which, starting at the upper end, include an upper adapter 204.

An upper neck portion 206 is threadedly connected to upper adapter 204 at threaded connection 208.

An outer setting sleeve guide section 210 is threadedly connected to the lower end of upper neck section 206 at threaded connection 212.

An inner setting sleeve guide section 214 is threadedly connected to outer setting sleeve guide section 210 at threaded connection 216 with a seal being provided therebetween by resilient O-ring seal 217.

A back-up seat housing section 218 is threadedly connected to inner setting sleeve guide section 214 at threaded connection 220, with a seal being provided therebetween by resilient O-ring 222.

A valve power housing section 224 is connected to the lower end of back-up seat housing section 218 at threaded connection 226, with a seal being provided therebetween by O-ring 228.

A shear pin housing section 230 is connected to the lower end of valve power housing section 224 at threaded connection 232 with a seal being provided therebetween by O-ring 234.

A ball valve housing section 236 is connected to a lower end of shear pin housing section 230 at threaded connection 238 with a seal being provided therebetween by O-ring 240.

Housing 200 also includes a lower ball valve seat holder 242 and an intermediate retaining collar 244 which are threadedly connected together at 246 with a seal being provided therebetween by O-ring 248.

Lower ball valve seat holder 242 includes a radially outward extending annular flange 250 which engages an upwardly facing annular surface 252 of ball valve housing section 236, and intermediate retaining collar 244 includes a radially outer upward facing annular surface 254 which abuts a lower end 256 of ball valve housing section 236.

Thus, the make-up of threaded connection 246 causes the lower ball valve seat holder 242 and the intermediate retainer collar 244 to tightly engage the ball valve housing section 236 at its upward facing annular surface 252 and its lower end 256 so that ball valve housing section 236, lower ball valve seat holder 242, and intermediate retaining collar 244 are all fixedly connected together.

A seal is provided between intermediate retaining collar 244 and ball valve housing section 236 by O-ring 258.

Housing 200 also includes an upper ball valve seat holder 260 which is connected to lower ball valve seat holder 242 by a plurality of C-shaped clamps (not shown).

Disposed in an upper counterbore of lower ball valve seat holder 242 is a lower seat 262 with a seal being provided therebetween by O-ring 264.

Disposed in a lower counterbore of upper ball valve seat holder 260 is an upper seat 266 with a seal being provided therebetween by O-ring 268.

Located above upper seat 266 are a pair of Belleville springs 270 for biasing the upper seat 266 downward.

Figure 7A:
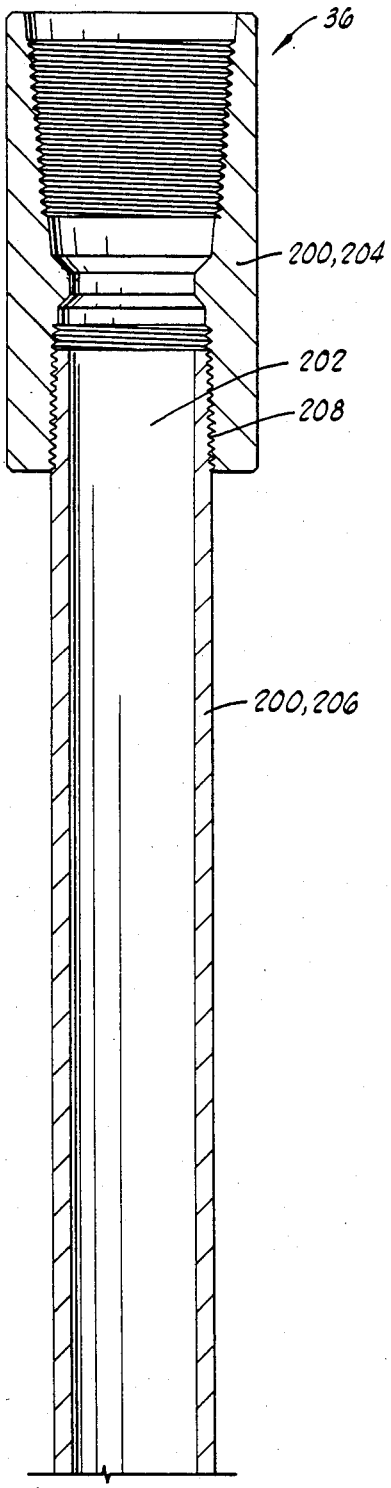
FIGS. 7A–7E comprise an elevation sectioned view of the liner hanger setting tool.
Figure 7B:
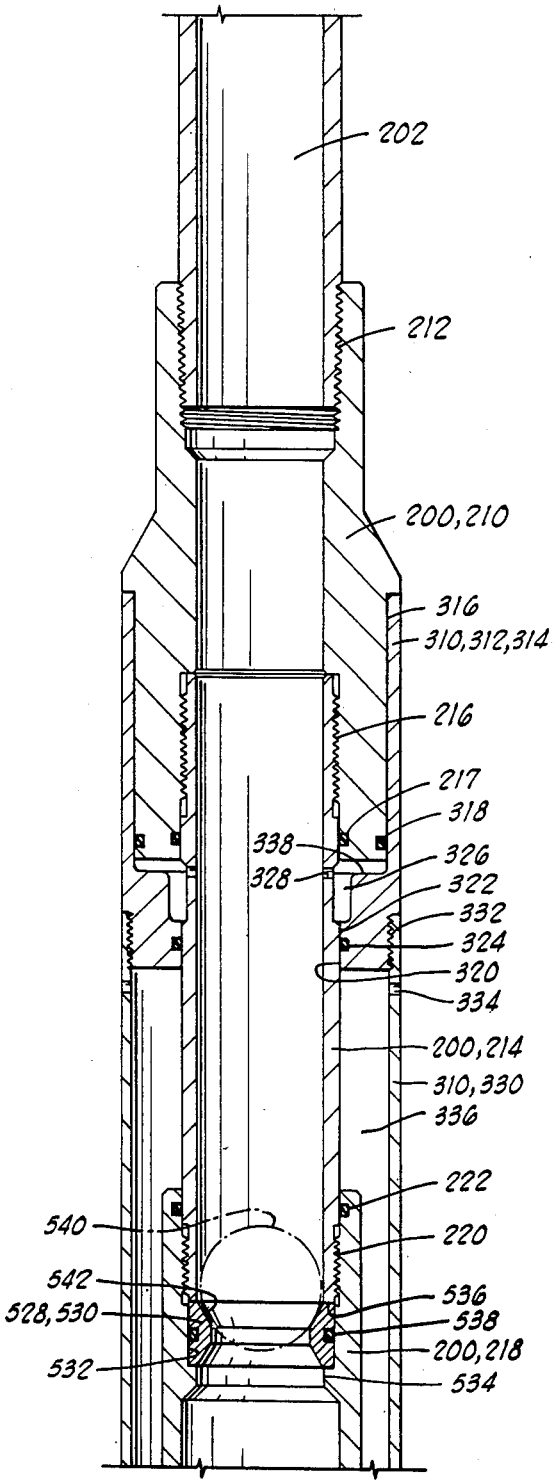
Figure 7C:
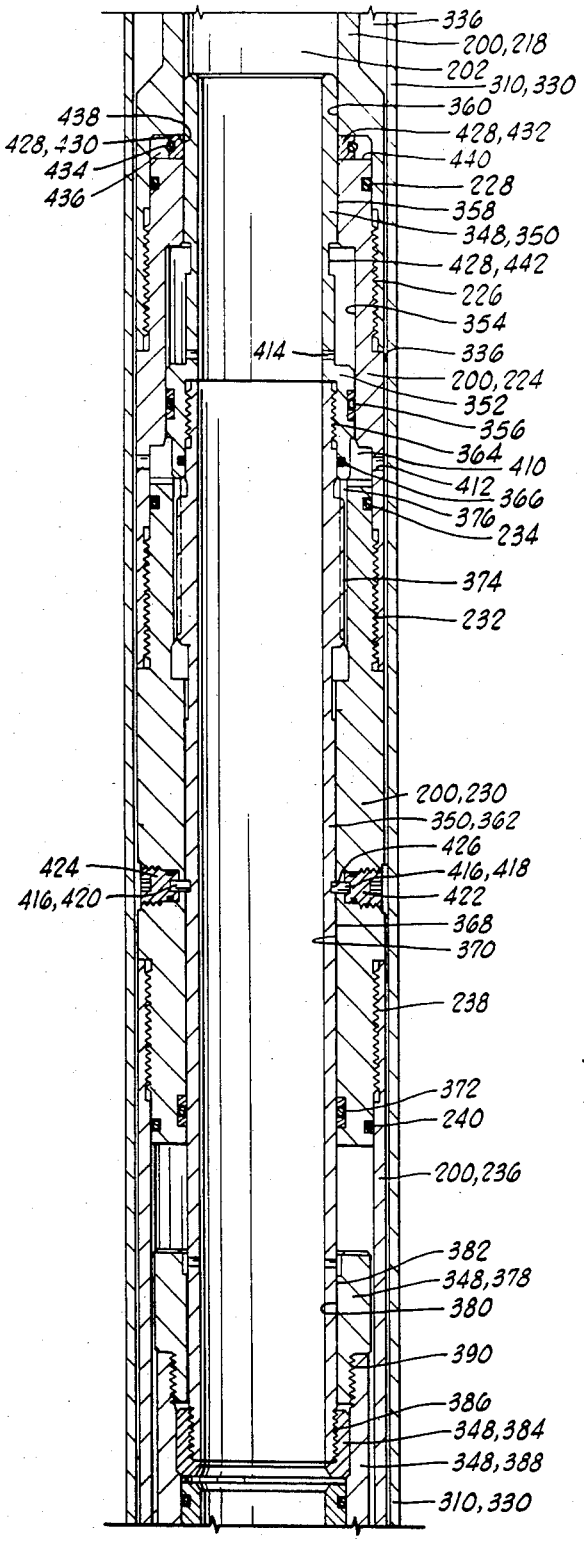
Figure 7D:
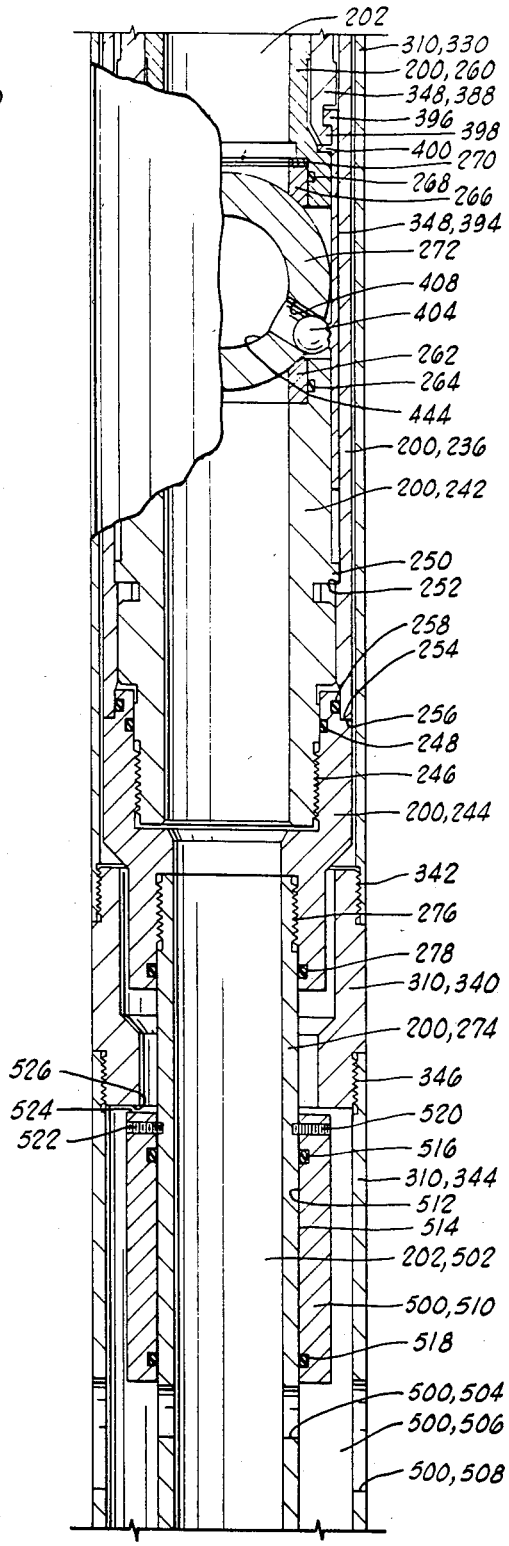

Sealingly received between the upper and lower seats 266 and 262 is a spherical ball valve means 272 which is shown in FIG. 7D in its closed position closing housing bore 202.

Housing 200 further includes a bypass housing section 274 connected to a lower end of intermediate retaining collar 244 at threaded connection 276 with a seal being provided therebetween by O-ring 278.

A rotating adapter 280 of housing 200 is connected to a lower end of bypass housing section 274 at threaded connection 282 with a seal being provided therebetween by O-ring 284.

Rotating adapter 280 includes a radially outward extending flange 286 which is rotatingly disposed between upper and lower bearings 288 and 290.

Housing 200 further includes a sealing adapter 292 which is threadedly connected at 294 to a bearing retainer collar 296 with a seal being provided therebetween by O-ring 298.

Bearing retainer collar 296 has a radially inward extending flange 300 closely received about an outer surface of rotating adapter 280 with a rotating seal 302 being provided therebetween.

By make-up of the threaded connection 294, the sealing adapter 292 and bearing retainer collar 296 are fixed about flange 286 of rotating adapter 280 so that rotating adapter 280 can rotate relative to sealing adapter 292 to disconnect the threaded connection 40 between liner hanger setting tool 36 and liner hanger means 38 in a manner to be further described below.

Finally, housing 200 of liner hanger setting tool includes a lower adapter 304 connected to a lower end of sealing adapter 292 at threaded connection 306 with a seal being provided therebetween by O-ring 308.

The liner hanger setting apparatus 36 further includes a differential pressure responsive setting means generally designated by the numeral 310, operably associated with the housing means 200 for setting the liner hanger means 38 within the well bore 14 in response to an increase in fluid pressure within an upper portion of the housing bore 202 above the closed ball valve means 272.

The differential pressure responsive setting means 310 includes a plurality of interconnected components which, beginning at the upper end seen in FIG. 7B, include a power piston section 312 having an upwardly extending annular skirt 314 closely received about a cylindrical outer surface 316 of outer setting sleeve guide section 210 with a sliding seal being provided therebetween by O-ring 318.

Power piston section 312 further includes a reduced diameter inner bore 320 which is closely and slidably received about a cylindrical outer surface 322 of inner setting sleeve guide section 214 with a sliding seal being provided therebetween by O-ring 324.

Between inner setting sleeve guide section 214 of housing 200 and power piston section 312, and between O-ring seals 217, 318 and 320 is defined an annular power chamber 326.

A tubing power port 328 is disposed through a wall of inner setting sleeve guide section 214 and thus communicates the housing bore 202 with the power chamber 326 so that fluid pressure contained within the housing bore 202 and within the bore of outer tubing string 34 is communicated with the power chamber 326 through the tubing power port 328.

Differential pressure responsive setting means 310 further includes an upper sleeve 330 connected to a lower end of power piston section 312 at threaded connection 332.

An annulus port 334 is disposed through upper sleeve 330 for communicating fluid pressure from well annulus 24 with an irregularly shaped annular cavity 336 defined between a portion of housing 200 and the upper sleeve 330.

Thus, any pressure differential between the outer tubing string 34 and the well annulus 24 acts downward across a power piston means 338 defined upon power piston section 312 between outer seal 318 and inner seal 324.

Differential pressure responsive setting means 310 also includes an intermediate adapter 340 connected to a lower end of upper sleeve 330 at threaded connection 342.

A lower sleeve 344 of differential pressure responsive setting means 310 is connected to a lower end of intermediate adapter 340 at threaded connection 346.

Figure 3A:
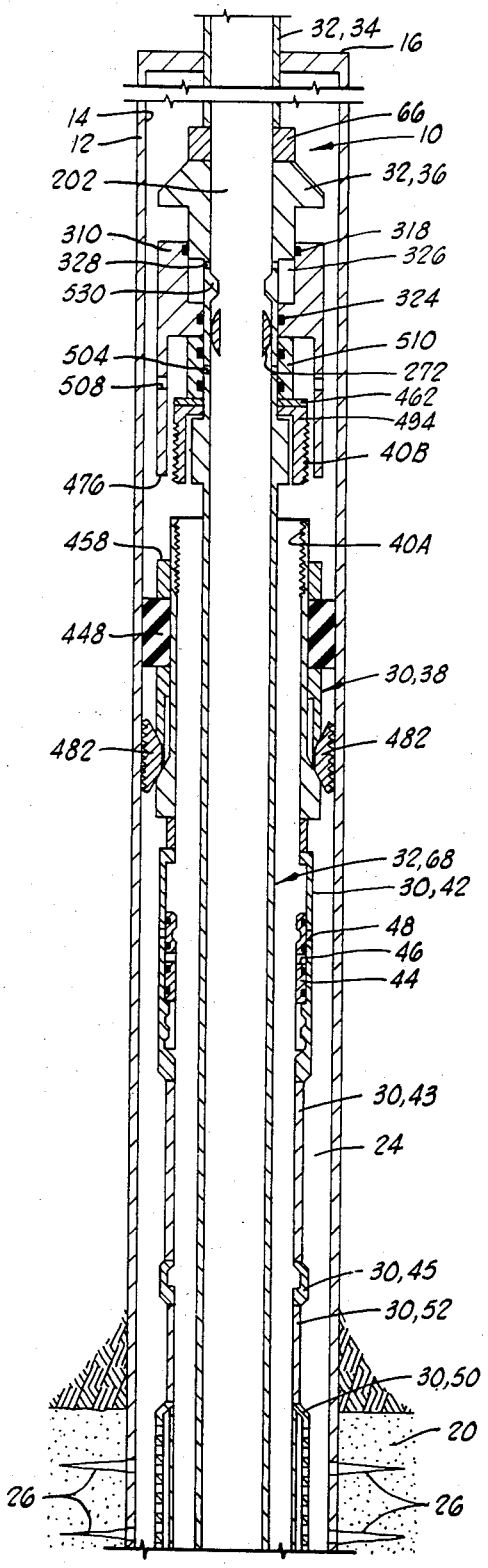
FIGS. 3A–3B are similar to FIGS. 1A–1B, and illustrate the system of the present invention after the liner hanger setting tool has been disconnected from the liner hanger means and after a zone isolation packer between adjacent zones has been set.

Liner hanger setting tool 36 also includes a differential pressure responsive valve actuating means generally designated by the numeral 348, operably associated with the ball valve means 272 for moving the ball valve means 272 from its initial closed position as illustrated in FIG. 7D to its open position such as schematically illustrated in FIG. 3A in response to an increase in fluid pressure within well annulus 24 external of the liner hanger setting tool 36.

Beginning at its upper end seen in FIG. 7C, the differential pressure responsive valve actuating means 348 includes an upper power mandrel 350 having a power piston means 352 defined thereon.

The power piston means 352 is closely and slidably received within a bore 354 of valve power housing section 224 with a sliding seal being provided therebetween by piston seal 356.

An upper outer cylindrical surface 358 of upper power mandrel 350 is closely and slidably received within a bore 360 of back-up seat housing section 218.

Differential pressure responsive valve actuating means 348 further includes a lower power mandrel 362 connected to upper power mandrel 350 at threaded connection 364 with a seal being provided therebetween by resilient O-ring 366.

An outer cylindrical surface 368 of lower power mandrel 362 is closely and slidably received within a bore 370 of shear pin housing section 230 with a seal being provided therebetween by O-ring 372.

Lower power mandrel 362 includes a plurality of radially outward extending splines 374 which are meshed with a plurality of radially inward extending splines 376 of shear pin housing section 230 to permit longitudinal motion therebetween while preventing relative rotational motion therebetween.

Differential pressure responsive valve actuating means 348 further includes an actuating collar 378 which has a bore 380 closely received about an outer cylindrical surface 382 of lower actuating mandrel 362.

A lower retaining cap 384 is threadedly connected to lower power mandrel 362 at threaded connection 386 so as to retain actuating collar 378 in place about lower power mandrel 362.

Differential pressure responsive valve actuating means 348 further includes a valve actuating sleeve 388 threadedly connected to actuating collar 378 at threaded connection 390.

An actuating arm 394 of acutating means 348 is connected to a lower end of actuating sleeve 388 by interconnecting flanges 396, 398 and 400. Actuating means 348 includes a second circumferentially spaced actuating arm which is not visible in the drawing.

Actuating arm 394 carries a radially inward extending actuating lug 404 which engages an eccentric bore 408 extending through the wall of ball valve means 272.

The differential pressure responsive actuating means 348 is constructed to be moved longitudinally upward within housing 200 in response to an increase in pressure within the well annulus 24, and that upward movement relative to housing 200 and relative to the ball valve 272 causes the ball valve 272 to be rotated from its initial closed position shown in FIG. 7D to an open position such as schematically illustrated in FIG. 3A.

This is accomplished as follows.

A lower side of power piston means 352 is in communication with an annular power chamber 410 defined between the upper and lower power mandrels 350 and 362 on the inside and valve power housing section 224 and shear pin housing section 230 on the outside. The effective outside diameter of power piston means 352 is defined by piston seal 356, and the effective inside diameter of power piston means 352 is defined by O-ring seal 372 disposed between lower power mandrel 362 and shear pin housing section 230.

The annular power chamber 410 is communicated with well annulus 24 through the irregularly shaped annular cavity 336 and a power port 412 disposed through a side wall of valve power housing section 224.

The upper side of power piston means 352 is connected with housing bore 202 through a low pressure port 414 disposed through upper power mandrel 350.

A releasable retaining means 416 comprised of a plurality of shear pins such as 418 and 420 is operably associated with the lower power mandrel 362 of valve actuating means 348 for initially retaining the valve actuating means 348 in an initial position as shown in FIGS. 7A–7E corresponding to the initial closed position of the ball valve means 272 shown in FIG. 7D.

The shear pins 418 and 420 are held in shear pin holders 422 and 424, respectively, and engage a recessed annular groove 426 disposed in the outer surface of lower power mandrel 362.

To open the ball valve means 272, the pressure within well annulus 24 is increased until the upward pressure differential acting across power piston means 352 reaches a predetermined level at which the shear pins such as 418 and 420 will shear, thus allowing the upper and lower power mandrels 350 and 362 to be moved upward along with the actuating collar 378, actuating sleeve 388, and actuating arm 394 to rotate the ball valve means 272 to its open position.

A locking means 428 is operably associated with the housing 200 and the valve actuating means 348 for locking the valve actuating means in a final position corresponding to the open position of the ball valve means 272.

The locking means 428 includes a plurality of segmented locking dogs such as 430 and 432 which are surrounded by an endless resilient biasing means 434 which biases the locking dogs 430 and 432 radially inward.

The locking dogs 430 and 432 are initially disposed in an annular cavity 436 defined by a longitudinal space between a downward facing shoulder 438 of back-up seat housing section 218 and an upper end 440 of valve power housing section 224.

Locking means 428 also includes a radially outwardly open annular groove 442 disposed in the outer cylindrical surface 358 of upper power mandrel 350, so that when the ball valve means 272 is in its open position, the groove 442 will be aligned with the annular cavity 436 so that the locking dogs such as 430 and 432 are biased radially inward by biasing means 434 into engagement with the groove 442 to thereby lock the valve actuating means 348 in a final position corresponding to the open position of the ball valve means 272.

When the ball valve means 272 is in its open position, a ball valve bore 444 thereof is aligned with the housing bore 202.

Figure 8A:
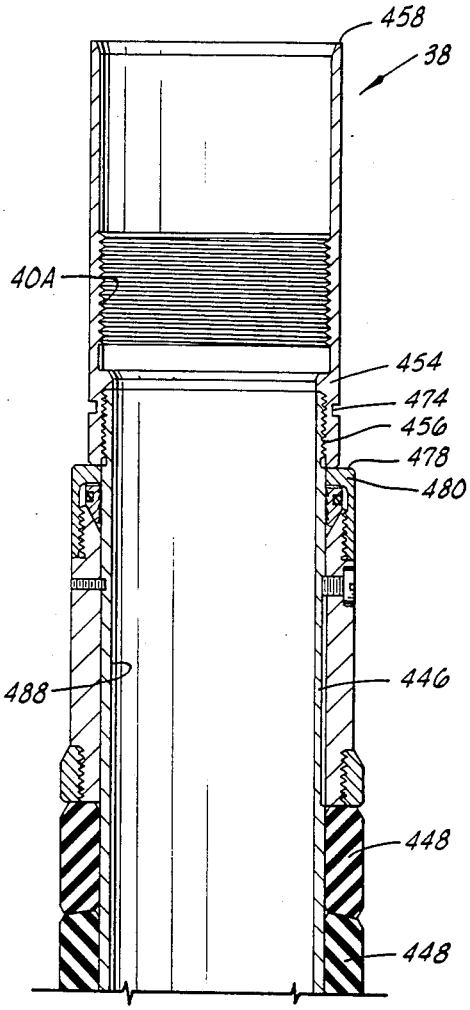
FIGS. 8A–8C comprise an elevation sectioned view of the liner hanger means.
Figure 8B:
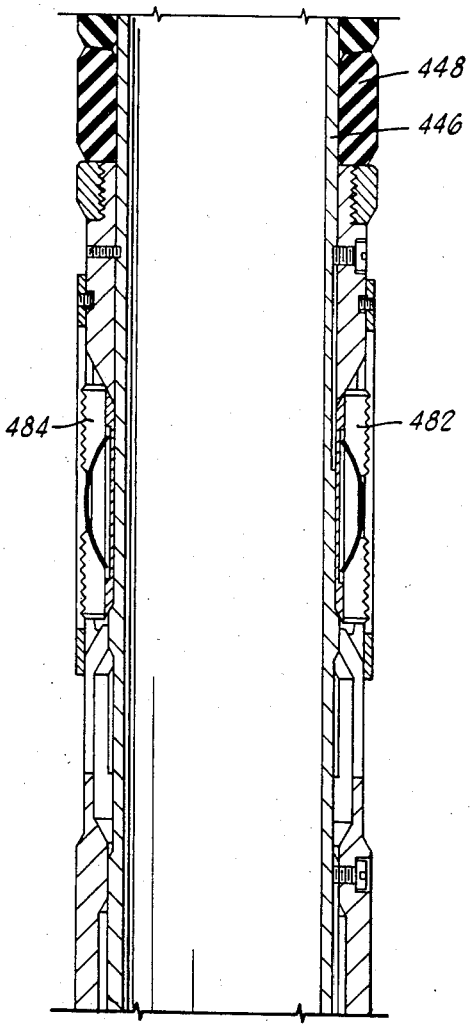
Figure 8C:
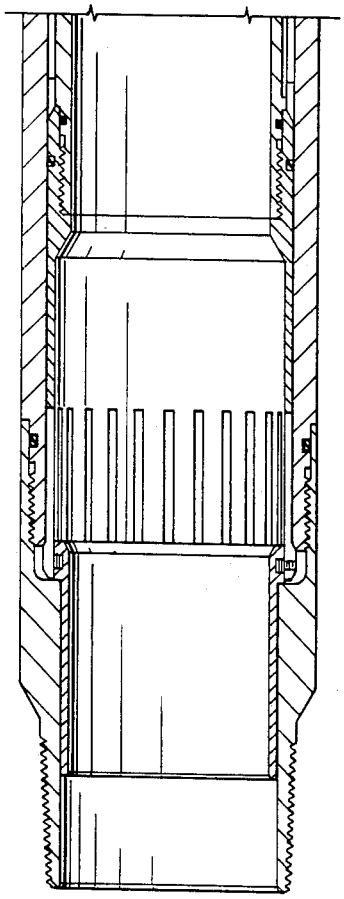

FIGS. 8A–8C comprise a schematic elevation view of the liner hanger means 38, and as schematically shown in FIG. 1A, the liner hanger setting tool 36 and liner hanger means 38 are detachably connected at threaded connection 40.

Figure 7E:
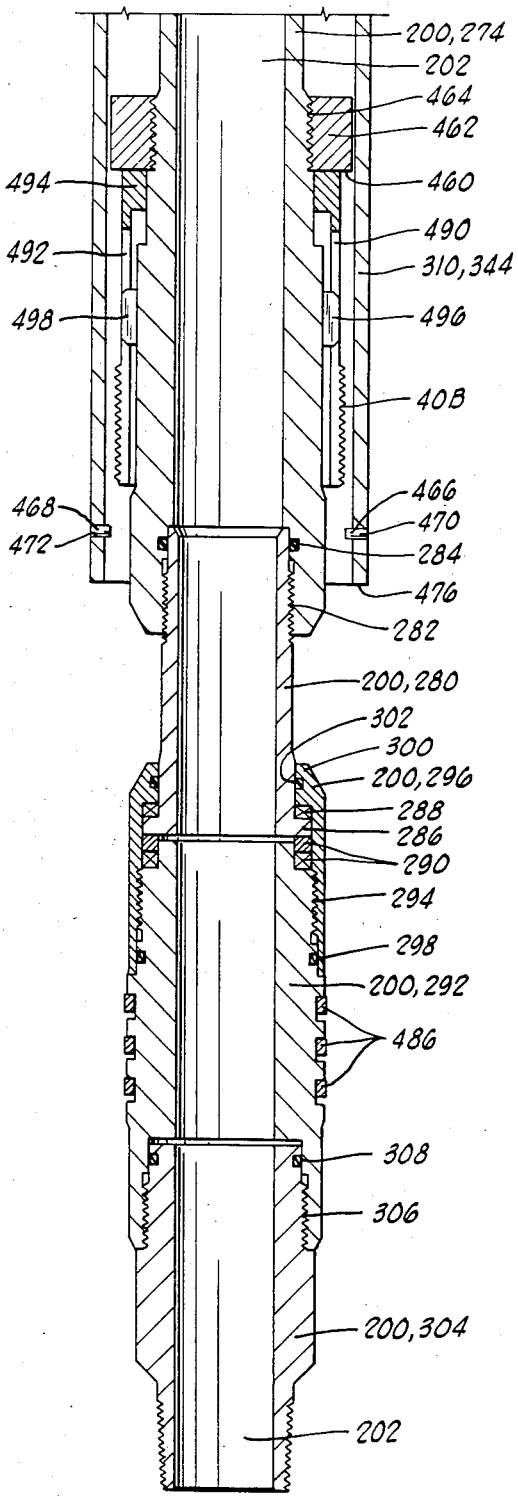

FIG. 8A, which is the upper end of liner hanger means 38, is shown immediately adjacent FIG. 7E in the drawings, with an internal thread 40A of liner hanger means 38 shown at the same elevation on the drawing sheet as an external thread 40B of liner hanger setting tool 36. It will be understood that the threads 40A and 40B, when made up, form the threaded connection 40 which is schematically shown in FIG. 1A.

The liner hanger means 38 is a compression packer which has a packer mandrel 446 about which are disposed a plurality of elastomeric sealing members 448.

The threads 40A are defined on an upper mandrel adapter 454 which is connected to packer mandrel 446 at threaded connection 456.

When the threads 40A and 40B of liner hanger means 38 and liner hanger setting tool 36, respectively, are made up, an upper end 458 of upper mandrel adapter 454 abuts a lower end 460 of threaded collar 462 of liner hanger setting tool 36. The threaded collar 462 is connected to bypass housing section 274 of housing 200 at threaded connection 464.

Also, after threads 40A and 40B are made up, a plurality of shear pins such as 466 and 468 are disposed through shear pin receiving holes 470 and 472 of lower sleeve 344 and engaged with an outwardly open annular groove 474 of upper mandrel adapter 454.

The shear pins 468 and 470 as engaged with the groove 474 provide a releasable retaining means for retaining differential pressure responsive setting means 310 in its initial position until such time as the downward pressure differential acting across the power piston means 338 reaches a predetermined level sufficient to shear the pins 466 and 468.

A lower end 476 of lower sleeve 344 abuts an upper end 478 of a packer ring 480.

Figure 2A:
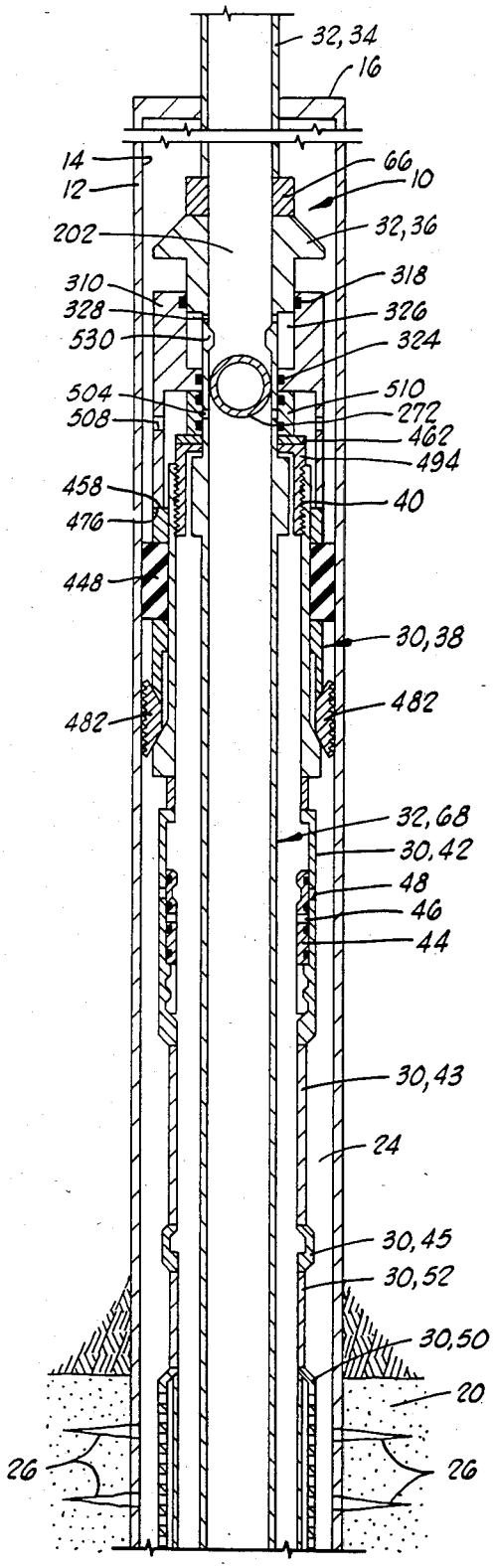
FIGS. 2A–2B are a view similar to FIGS. 1A–1B after the liner hanger means has been set within the well.

When the lower sleeve 344 is pushed downward by the power piston 338, it causes expandable slips such as 482 and 484 of liner hanger means 38 to expand outward into engagement with well bore 14, and then causes the elastomeric sealing members 448 to be longitudinally compressed and expanded radially outward into engagement with well bore 14 as schematically illustrated in FIG. 2A.

The sealing adapter 292 of housing 200 of liner hanger setting tool 36, seen in FIG. 7E includes a plurality of outer annular seals 486 for sealing against an inner bore 488 of packer mandrel 446.

The threads 40B of liner hanger setting tool 36 are defined on a plurality of collet fingers such as 490 and 492 of an annular collet 494.

Bypass housing section 274 includes a plurality of radially outward extending lugs such as 496 and 498 which extend between the longitudinal spaces between adjacent ones of the collet fingers such as 490 and 492, so that the collet 494 will be rotated with the bypass housing section 274.

After the liner hanger means 38 has been set within the well bore 14 as schematically illustrated in FIG. 2A, the threaded connection 40 can be disconnected by rotation of the outer tubing string 34. Those portions of liner hanger setting tool 36 above the bearings 288 and 290 will rotate with the outer tubing string 34, and the liner hanger means 38 which has been set within the well bore 14 will remain fixed, so that the threaded connection 40 is disconnected as schematically illustrated in FIG. 3A.

The liner hanger setting tool 36 further includes an initially open bypass means 500 (see FIG. 7D) operably associated with the housing means 200 for allowing well fluids within a lower portion 502 of housing bore 202 below the initially closed ball valve means 272 to bypass the initially closed ball valve means 272 as the liner hanger setting tool 36 is lowered into the well as schematically illustrated in FIGS. 1A–1B.

The bypass means 500 includes a housing bypass port 504 disposed through a wall of bypass housing section 274, an annular cavity 506 between bypass housing section 274 and lower sleeve 344, and a sleeve bypass port 508 disposed through lower sleeve 344, all of which combine to form a bypass passage communicating the lower portion 502 of housing bore 202 with the well annulus 24 above the sealing element 448 of liner hanger means 38.

Thus, as the liner hanger setting tool 36 is initially lowered into the well as schematically illustrated in FIGS. 1A–1B, well fluid within the lower portion 502 of housing bore 202 may flow outward through port 504, annular cavity 506, and port 508 into the annular cavity 24.

Bypass means 500 further includes a sliding sleeve bypass valve 510 having a bore 512 closely received about an outer cylindrical surface 514 of bypass housing section 274 with upper and lower sliding seals provided therebetween by O-rings 516 and 518.

The sliding sleeve bypass valve 510 is initially releasably retained in its open position as shown in FIG. 7D by a plurality of shear pins such as 520 and 522 disposed between sliding sleeve bypass valve 510 and bypass housing section 274.

An upper end 524 of sliding sleeve bypass valve 510 is located directly under a lower end 526 of intermediate adapter 340 of differential pressure responsive setting means 310 so that when differential pressure responsive setting means 310 moves downward to set the liner hanger means 38, the lower end 526 of intermediate adapter 340 engages the upper end 524 of sliding sleeve bypass valve 510, thus shearing the shear pins 520 and 522 and moving sliding sleeve bypass valve 510 downward relative to bypass housing section 274 so that port 504 thereof is located between upper and lower seals 516 and 518 thus closing the port 504, as schematically illustrated in FIG. 2A.

As previously mentioned, a locking means 428 locks the valve actuating means 348 in a final position corresponding to an open position of the ball valve means 272, and the ball valve means 272 cannot then be reopened.

In some instances, however, it may be determined after the ball valve means 272 has been locked in its open position that it is necessary to apply additional setting force to the liner hanger means 38. To do this, it is necessary to once again close the housing bore 202 below the tubing power port 328. This is accomplished with a back-up valve means 528 shown in FIG. 7B.

The back-up valve means 528 includes an annular back-up valve seat 530 which is received within a bore 532 of back-up seat housing section 218 and held in place therein between a radially inward extending flange 534 of back-up seat housing section 218 and a lower end 536 of inner setting sleeve guide section 214. A seal is provided between back-up valve seat 530 and bore 532 by O-ring 538.

In those unusual circumstances when it is necessary to reclose the housing bore 202, a ball 540, shown in phantom lines in FIG. 7B, is allowed to free fall or is pumped down the outer tubing string 34 to seat against an upward facing seating surface 542 of annular back-up valve seat 530 as illustrated in FIG. 7B.

Then, setting pressure can again be applied to the differential pressure responsive setting means 310. After the differential pressure responsive setting means 310 is again actuated to reset the liner hanger 38, it is necessary to reverse-circulate the ball 540 up out of the outer tubing string 34.

Details of the Isolation Gravel Packer

Referring now to FIGS. 9A–9H, an elevation right-side only sectioned view is thereshown of the details of construction of the isolation gravel packer 70. The isolation gravel packer 70 includes an isolation gravel packer housing means 700.

Figure 9A:
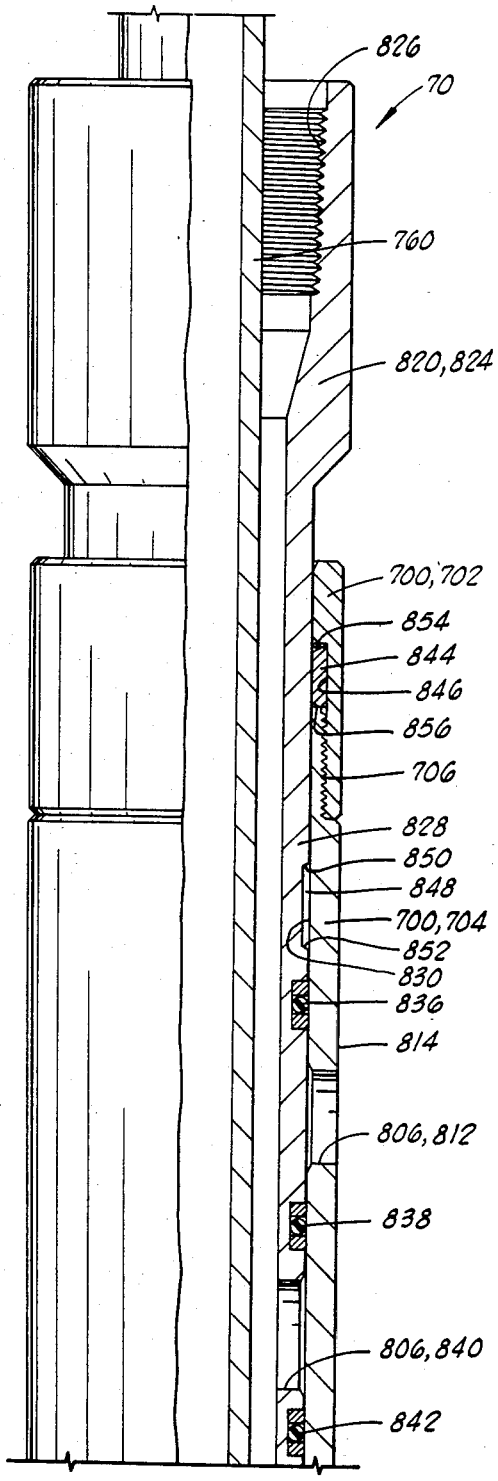
FIGS. 9A–9H comprise an elevation right-side only sectioned view of the isolation gravel packer apparatus with the concentric inner tubing string received therein as shown schematically in FIGS. 5A–5B and 6A–6B.

The housing means 700 is comprised of a plurality of interconnected components which, beginning at its upper end shown in FIG. 9A, includes an upper collar 702.

An upper bypass housing section 704 is connected to a lower end of collar 702 at threaded connection 706.

An upper seal housing section 708 is connected to a lower end of upper bypass housing section 704 at threaded connection 710 with a seal being provided therebetween by O-ring 712.

An intermediate adapter section 714 is connected to a lower end of upper seal housing section 708 at threaded connection 716 with a seal being provided therebetween by O-ring 718.

A gravel port housing section 720 is connected to a lower end of intermediate adapter section 714 at threaded connection 722 with a seal being provided therebetween by O-ring 724.

An intermediate spacer housing section 726 is connected to a lower end of gravel port housing section 720 at threaded connection 728 with a seal being provided therebetween by O-ring 730.

A lower seal housing section 732 is connected to a lower end of intermediate spacer housing section 726 at threaded connection 734 with a seal being provided therebetween by O-ring 736.

A lower bypass housing section 738 is connected to a lower end of lower seal housing section 732 at threaded connection 740 with a seal being provided therebetween by O-ring 742.

Finally, housing 700 includes a lower collar 744 connected to a lower end of lower bypass housing section 738 at threaded connection 746.

Isolation gravel packer 70, which may be generally described as a well treatment apparatus 70, also includes a stinger receptacle generally designated by the numeral 748 disposed in the housing 700.

The stinger receptacle 748 includes an open end 750 and a closed lower end 752 which is closed by threaded plug 754.

Stinger receptacle 748 further includes an inner cylindrical seal bore 756. As shown in FIG. 9D, seal bore 756 closely and sealingly receives a lower stinger end 758 of a concentric inner tubing string 760. The manner of operation of concentric inner tubing string 760 is further described below with regard to the schematic illustrations of FIGS. 5A–5B and 6A–6B.

The isolation gravel packer 70 further includes a treatment fluid passage means 762, which may also be referred to as a gravel laden slurry passage means 762, disposed laterally through the housing means 700 for communicating an interior 764 of stinger receptacle 748 at an elevation below the seal bore 756 with the well annulus 24 adjacent the subsurface zone 22 which is to be gravel-packed.

Figure 5A:
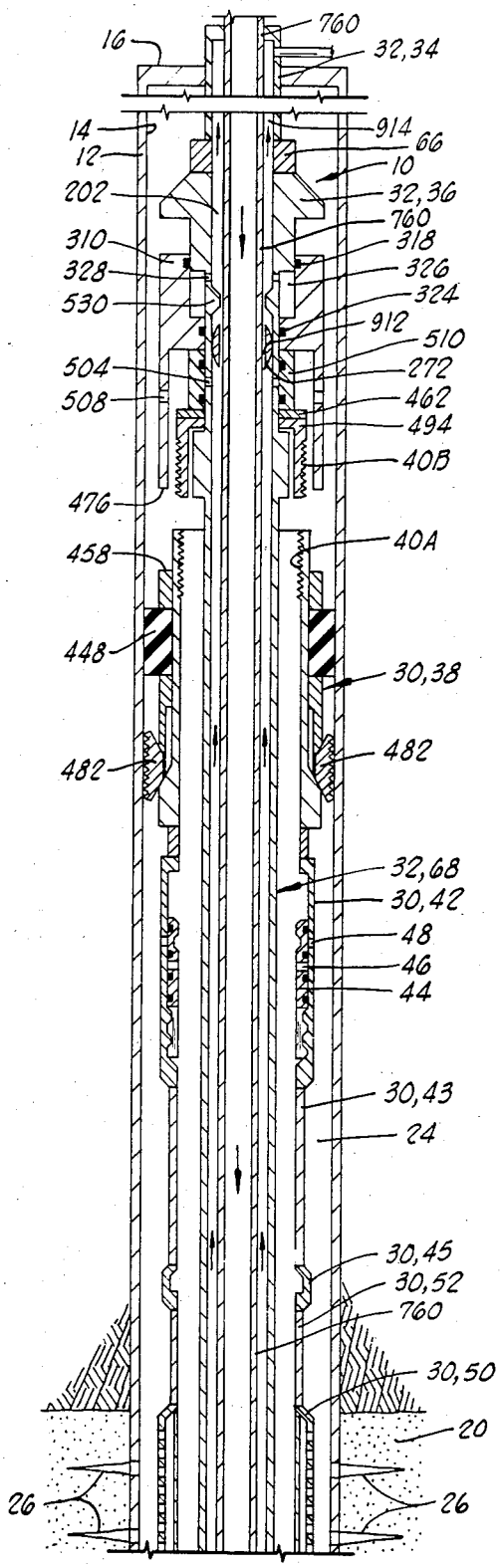
FIGS. 5A–5B are similar to FIGS. 1A–1B and illustrate the system of the present invention during the gravel-packing operation when gravel laden slurry is being directed to the lowermost one of the producing zones of the well, and with return fluid flowing back from the zone being packed.
Figure 5B:
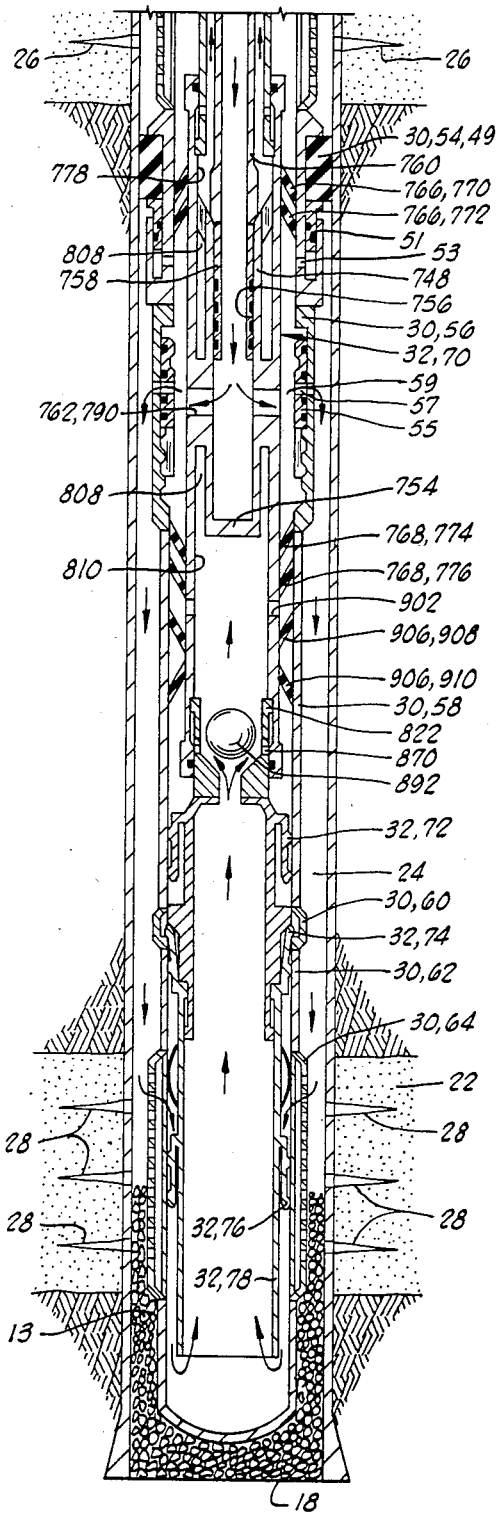

As seen in FIG. 5B, this communication is provided through the passage 762, then through the ports 57 and 59 of the second sleeve valve means 56 into the well annulus 24 above the subsurface zone 22. As will be understood by those skilled in the art, the gravel laden slurry is introduced into the well annulus 24 above the location which is actually to be packed, and the gravel laden slurry is then allowed to settle down through the annulus 24 to fill the annulus 24 surrounding the production screen means 64 as indicated at 13.

The isolation gravel packer 70 includes first and second seal means 766 and 768 disposed on an exterior of the housing means 700 above and below the treatment fluid passage means 762, respectively, for sealing between the housing means 700 and a bore of liner string 30 as schematically illustrated in FIGS. 5A–5B.

The first seal means 766 includes downwardly open sealing cups 770 and 772 for preventing upward flow of fluid therepast.

The second seal means 768 includes upwardly open seal cups 774 and 776 for preventing downwardly flow of fluid therepast.

The seal bore 756 of stinger receptacle 748 is of reduced internal diameter as compared to an upper housing bore 778 of gravel port housing section 720 above the seal bore 756.

The isolation gravel packer 70 further includes an upwardly facing, conically tapered, radially inner guide surface 780 located above the open upper end 750 of stinger receptacle 748 for guiding the lower stinger 758 of concentric inner tubing string 760 into the seal bore 756.

As seen in FIG. 9D, lower stinger 758 carries the plurality of annular O-ring seals 782 for sealing between stinger 758 and seal bore 756.

Additionally, lower stinger 758 has defined thereon a complementary, downwardly facing, conically tapered, radially outer surface 784 which engages the guide surface 780 to thereby define a fully inserted position of the stinger 758 within the seal bore 756 as illustrated in FIG. 9D.

The stinger receptacle 748 is an elongated tubular member which is spaced radially inward for the most part from gravel port housing section 720 to define an annular cavity 786 therebetween.

At an intermediate portion of stinger receptacle 748, a plurality of lugs 788 extend radially outward, and each of said lugs has a treating fluid passage means such as 762 defined therethrough which is aligned with an opening 790 in gravel port housing section 720.

The lugs such as 788 are fixedly connected to the gravel port housing section 720 by an annular weld 792 circumscribing the aligned ports or passages 790 and 762.

Figure 9B:
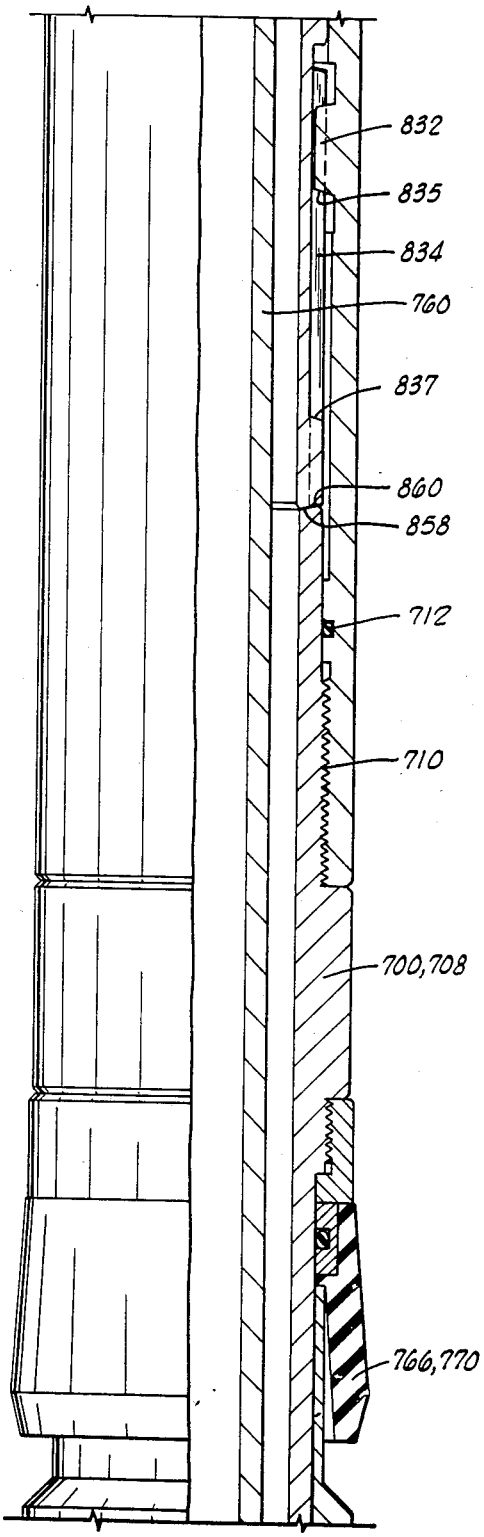
Figure 9C:
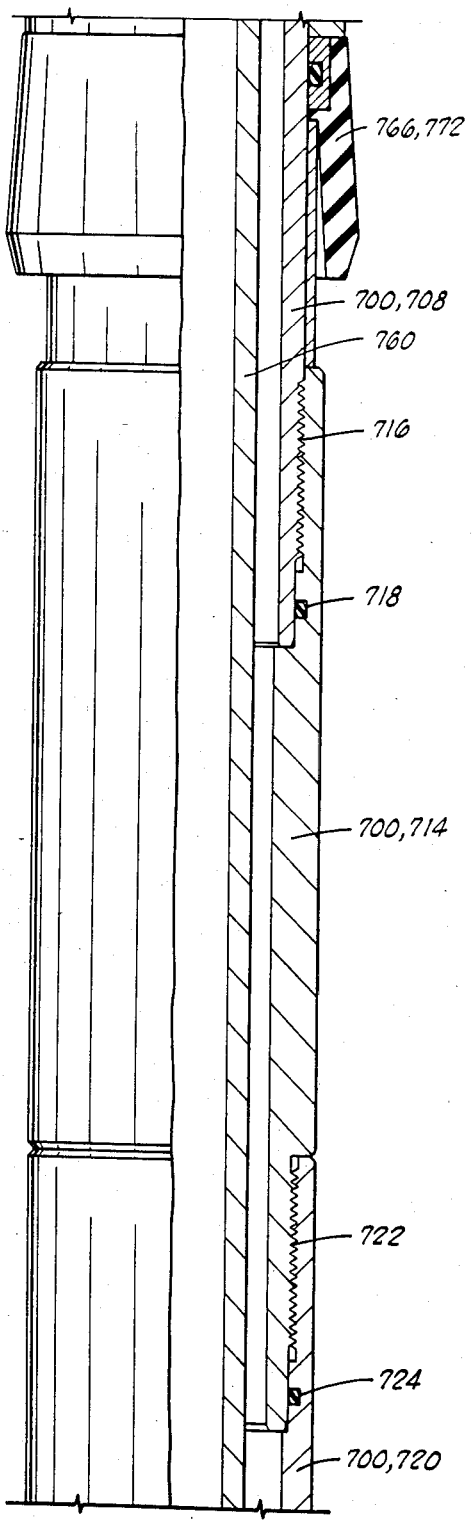
Figure 9D:
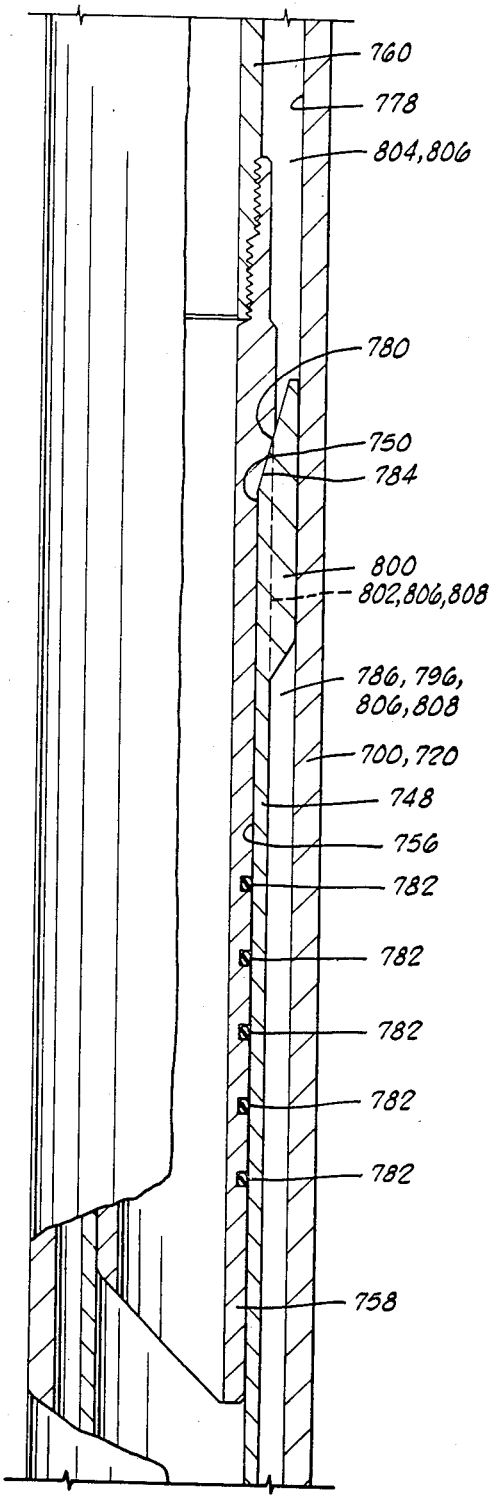
Figure 9E:
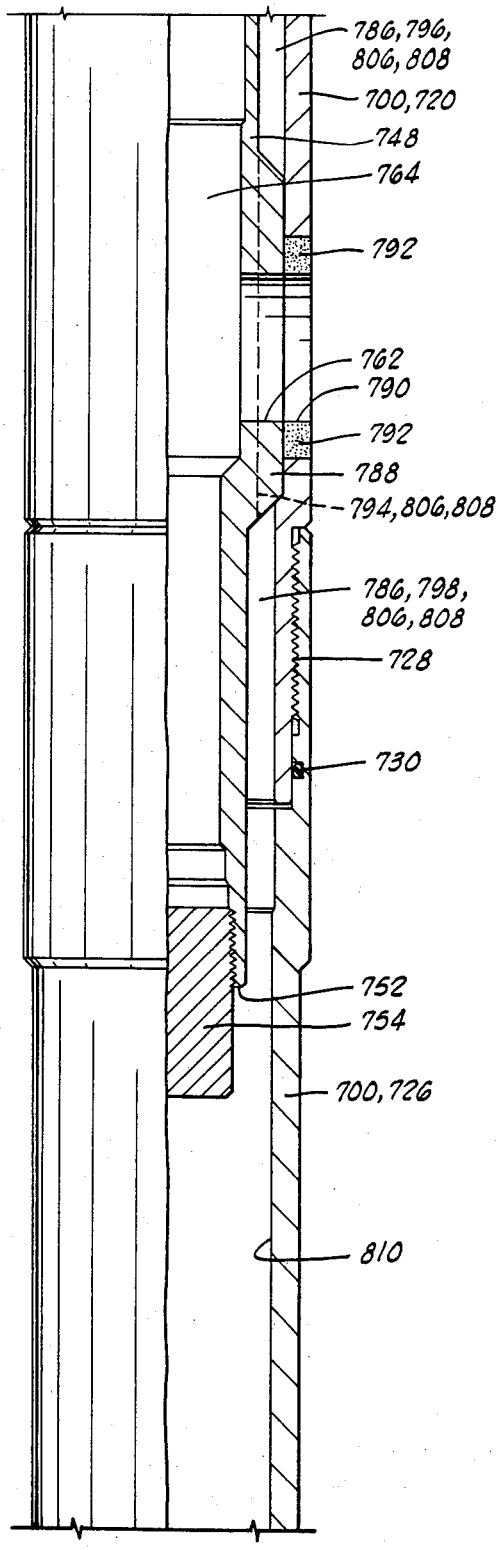
Figure 9F:
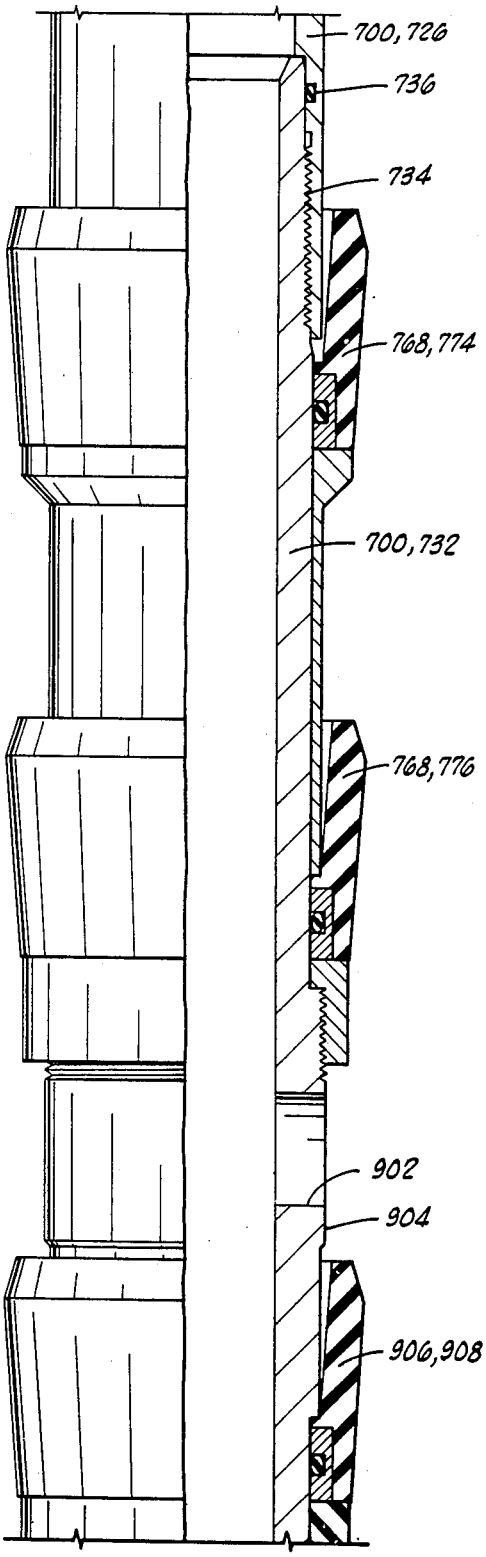

As indicated by dashed lines in FIG. 9E, there are circumferentially spaced, longitudinally extending spaces such as 794 between lugs such as 788, which spaces 794 communicate an upper portion 796 of annular cavity 786 with a lower portion 798 of the annular cavity 786.

Additionally, adjacent the upper end of stinger receptacle 748 as seen in FIG. 9D, there are a plurality of radially outward extending lugs such as 800 which freely engage the inner bore 778 of gravel port housing section 720. Again, there are circumferentially located spaces such as 802 located between adjacent lugs 800 thus communicating the upper portion 796 of annular cavity 786 with an annular space 804 defined between concentric inner tubing string 760 and gravel port housing section 720.

The isolation gravel packer 70 also includes a bypass means generally designated by the numeral 806 disposed in the housing 700 for bypassing well fluid around the first and second external seals 766 and 768 as the isolation gravel packer 70 is moved longitudinally within the well and particularly within the liner string 30.

The bypass means 806 includes a substantially annular longitudinal bypass passage 808 which is comprised of the lower portion 798 of annular cavity 786, the spaces 794 between adjacent lugs 788, the upper portion 796 of annular cavity 786, and the spaces 802 between adjacent lugs 800.

The longitudinal bypass passage 808 also defines a portion of a return fluid path for treatment fluid returning from the annulus adjacent the well zone 22 which is being gravel-packed, in a manner that will be further described below with regard to the overall operation of the invention.

The longitudinal bypass passage 808 communicates the upper housing bore 778 of housing 700 above the seal bore 756 with a lower housing bore 810 below the closed lower end 752 of stinger receptacle 748. The longitudinal bypass passage 808 is isolated from the treatment fluid passage means 762 when the concentric inner tubing string 760 is sealingly received within the seal bore 756 as illustrated in FIG. 9D.

The bypass means 806 further includes an upper lateral bypass passage 812 disposed through the housing 700 for communicating the upper housing bore 778 with an upper exterior portion 814 of housing 700 above the first external seal means 766.

Bypass means 806 also includes a lower lateral bypass passage 816 disposed through the housing means 700 for communicating the lower housing bore 810 with a lower exterior portion 818 of housing means 700 below the second external seal means 768, so that as the isolation gravel packer 70 is moved longitudinally within the liner string 30, well fluid can bypass the first and second external seal means 766 and 768 by flowing either upwards or downwards through a path including the lower lateral bypass passage 816, the lower housing bore 810, the longitudinal bypass passage means 808, the upper housing bore 778, and the upper lateral bypass passage 812.

The isolation gravel packer 70 further includes upper and lower bypass valve means 820 and 822 for selectively closing and opening the upper and lower lateral bypass passages 812 and 816, respectively.

Both the upper and lower bypass valves 820 and 822 are sliding sleeve type bypass valves constructed to be closed when a compression loading is applied longitudinally across the isolatino gravel packer 70 and to be opened when a tension loading is applied longitudinally across the isolation gravel packer 70.

The upper bypass valve 820 includes an uppermost adapter portion 824 which is internally threaded at 826 for connection thereof to the spacer tubing 68 as seen in FIG. 1A.

Extending downwardly from adapter portion 824 is a tubular sleeve portion 828 which is telescopingly received within a bore 830 of upper bypass housing section 704.

Upper bypass housing section 704 includes a lug 832 received within a J-slot 834 of sleeve portion 828. The open position of upper bypass valve 820 is defined by abutment of a lower surface 835 of lug 832 with a lower extremity 837 of J-slot 834.

Upper bypass valve 820 is shown in FIGS. 9A–9B in its closed position, wherein first and second annular seals 836 and 838 seal above and below the upper lateral bypass passage 812 to prevent flow therethrough.

When a tension loading is applied across the isolation gravel packer 70, the upper bypass valve 820 will slide longitudinally upward relative to housing 700 until a valve port 840 thereof is aligned with upper lateral bypass passage 812, so that seal 838 is above lateral bypass passage 812, and a third seal 842 is below lateral bypass passage 812.

A resilient annular retainer clip 844 is disposed in a radially inward facing annular groove 846 defined between upper collar 702 and upper bypass housing section 704.

When the upper bypass valve 820 is in its open position so that valve port 840 is aligned with upper lateral bypass passage 812, a radially outward facing groove 848 of upper bypass valve 820 is aligned with retainer clip 844 and the inward resilience of retainer clip 844 causes it to move inward into groove 848 thus releasably locking the upper bypass valve 820 in its open position.

It is noted that the groove 848 is tapered as at 850 and 852 at its upper and lower extremities, respectively. Similarly, the retainer clip 844 is tapered as at 854 and 856 at its upper and lower extremities, respectively, so that groove 848 and retainer clip 844 work together with a cam type action so that when a sufficient compressional loading is subsequently placed across isolation gravel packer 70, the retainer clip 844 will be cammed outward out of groove 848 so that it once again is fully received within groove 846 as shown in FIG. 9A.

The fully longitudinally compressed closed position of upper bypass valve 820 is defined by abutment of a lower end 858 of sleeve portion 828 with an upper end 860 of upper seal housing section 708.

The lower bypass valve 822 is for the most part similarly constructed, in that it has a sleeve portion 862 slidably received within a bore 864 of lower bypass housing section 738.

Figure 9G:
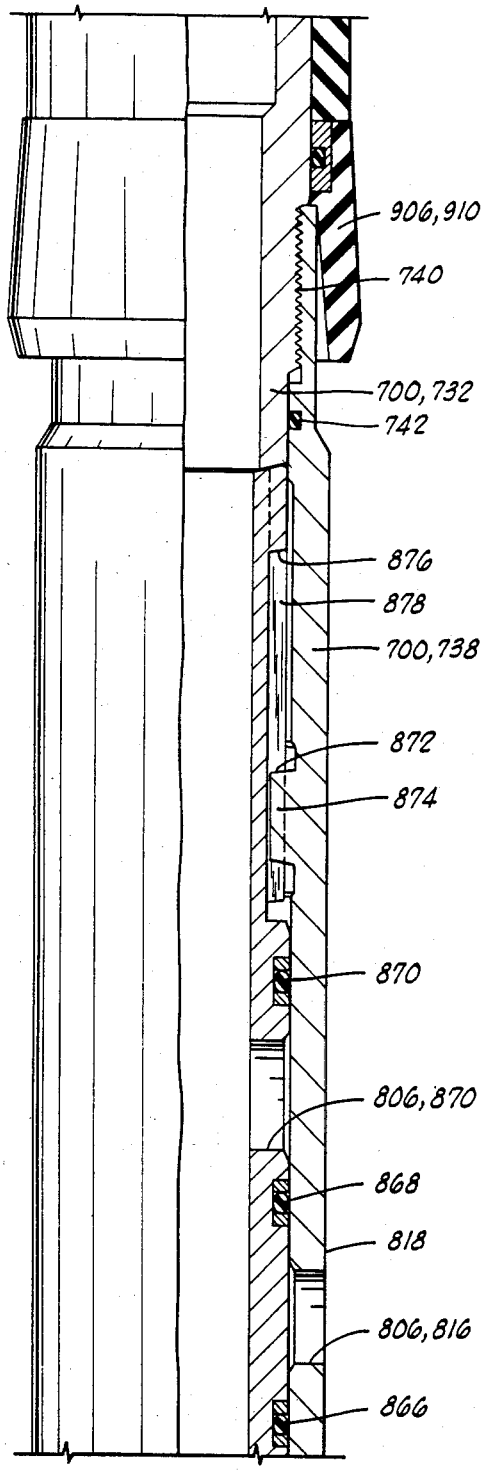

First and second seals 866 and 868 are disposed on opposite sides of lower lateral bypass passage 816 when the lower bypass valve 822 is in its closed position as illustrated in FIG. 9G.

Lower bypass valve 822 further includes a valve port 870 arranged to be aligned with lower lateral bypass passage 816 when the valve 822 is in its open position so that second seal 868 is located below and a third seal 870 is located above the lower lateral bypass passage 816.

The fully extended open position of lower bypass valve 822 is defined by abutment of an upward facing surface 872 of a radially inward projecting lug 874 with an upper extremity 876 of J-slot 878 within which the lug 874 is received.

Connected to the lower end of sleeve portion 862 of lower bypass valve 820 is a check valve housing 880 which is connected to sleeve portion 862 at threaded connection 882. A valve seat nipple 884 is connected to the lower end of check valve housing 880 at threaded connection 886 with a seal being provided therebetween by O-ring 888.

Valve seat nipple 884 has a tapered annular ball seating surface 890 defined on its upper end.

Figure 9H:
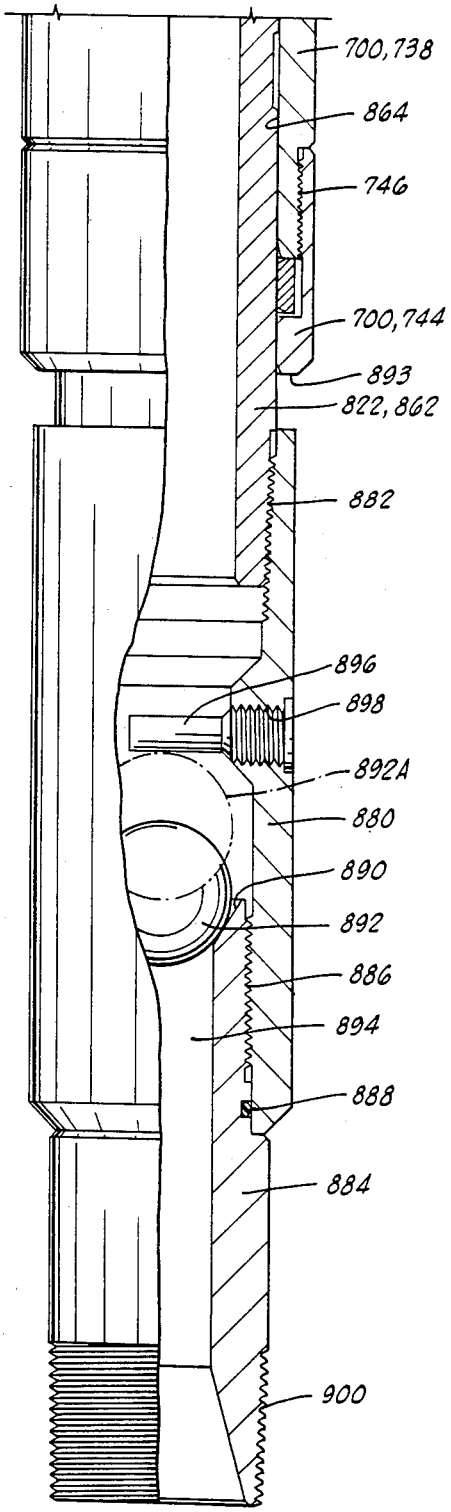

A spherical one-way check valve ball 892 is shown in FIG. 9H in a seated position closing the bore 894 of valve seat nipple 884. This prevents downward flow of fluid through the open lower end 893 of housing means 700. Upward flow of fluid through the open lower end 893, and particularly through bore 894, is permitted by the check ball 892 by movement thereof to its upper unseated position shown in phantom lines and designated by the numeral 892A.

The upwardmost position of check ball 892 is defined by engagement thereof with a radially inward extending ball stop lug 896 which is threadedly connected to a side wall of check valve housing 880 at threaded connection 898.

Valve seat nipple 884 has a threaded connection 900 at its lower end for connection thereof to the opening positioner 72 and other related apparatus located therebelow in the operating string 30 as schematically illustrated in FIG. 1B.

The isolation gravel packer 70 further includes reverse-circulation passage means 902 (see FIG. 9F) disposed laterally through the housing 700 for communicating the lower housing bore 810 with an exterior portion 904 of housing 700 below the second external seal means 768.

Figure 6A:
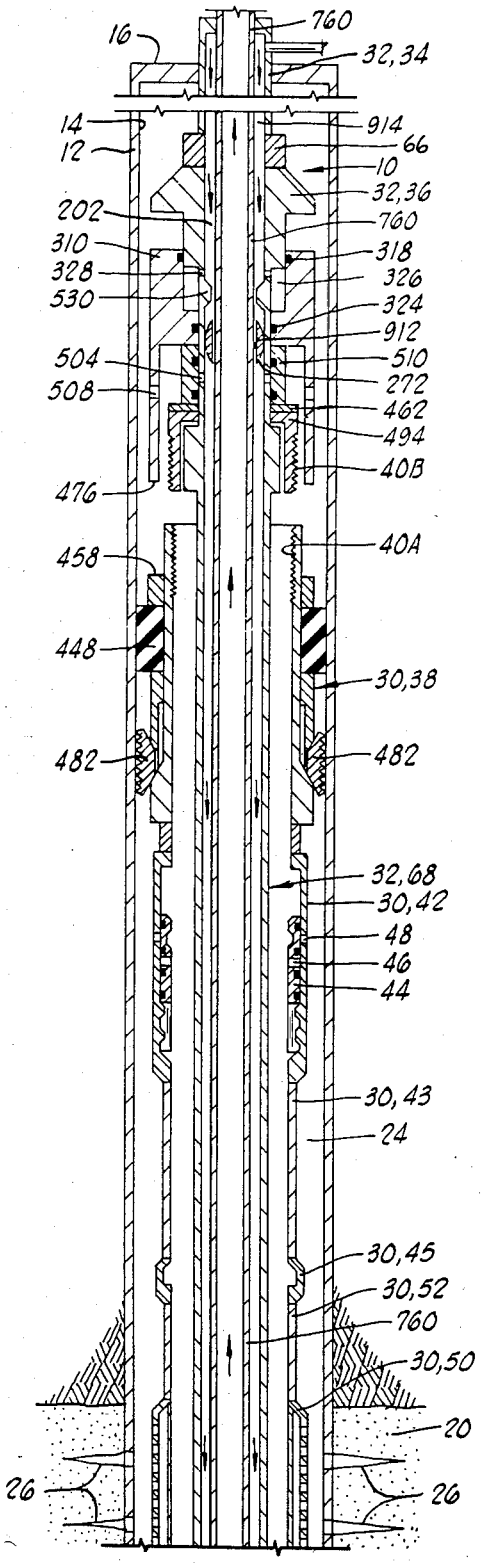
FIGS. 6A–6B are similar to FIGS. 1A–1B and show the system of the present invention during the reverse-circulation procedure wherein gravel laden slurry remaining in the operating string is being reversed out of the operating string.
Figure 6B:
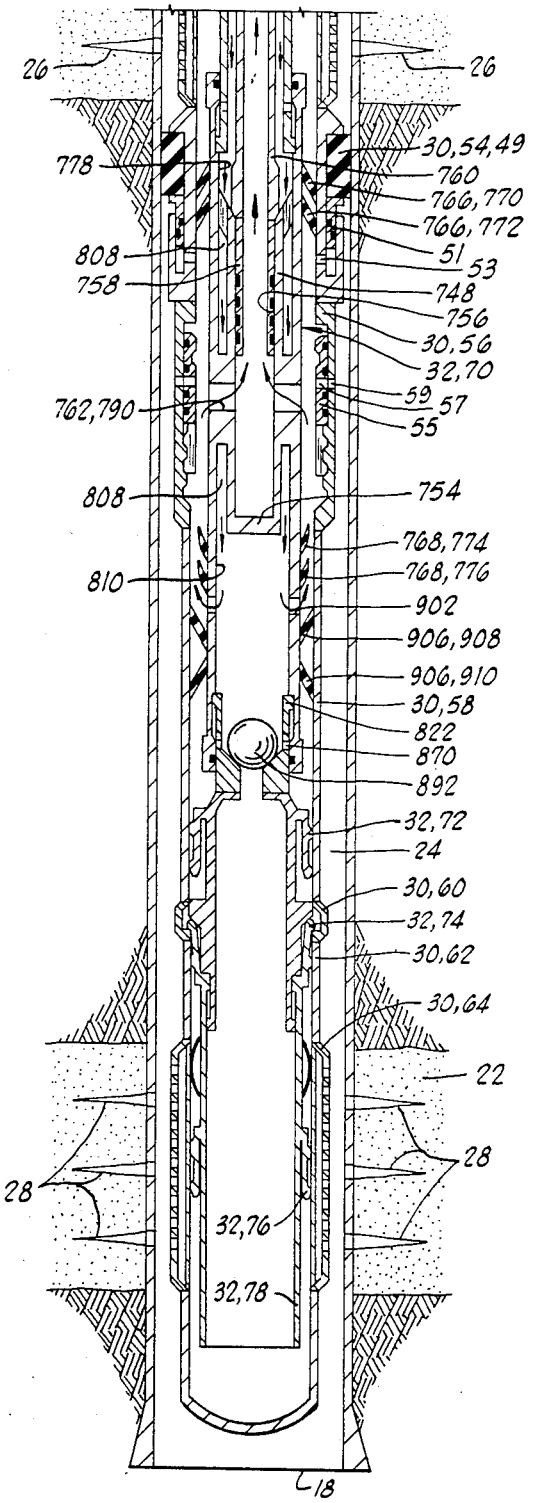

As previously mentioned, the second external seal means 768 is comprised of a pair of upwardly open sealing cups 774 and 776 which function as a one-way seal means 768 for preventing flow of treatment fluid from the treatment fluid passage 762 downward between the housing 700 and the liner string 30 to the reverse-circulation passage means 902, and for permitting upward flow of reverse-circulation fluid from the reverse-circulation passage 902 upward between the housing 700 and the bore of liner string 30 and then into the treatment fluid passage 762 in a manner that will also be further described below with regard to the schematic representation shown in FIG. 6A–6B.

A third external seal means 906 is disposed on the exterior of housing 700 below the reverse-circulation passage 902. The third seal means 906 includes an upper upwardly open sealing cup 908 and a lower downwardly open sealing cup 910 so that third seal means 906 prevents flow of fluid in either direction between the housing 700 and the bore of liner string 30.

It is noted that the reverse-circulation passage 902 is located between the second seal means 768 and the third seal means 906.

Description of the Overall Operation of the System

FIGS. 1A–1B

Running Into The Well

FIGS. 1A–1B illustrate the combined liner string 30 and operating string 32 as they are initially being run into the well on outer tubing string 34.

Initially, the fill-up valve means 66 is opened as represented by the open port 67.

This permits the outer tubing string 34 to fill with well fluid as the system 10 is being lowered into the well bore 14.

The ball valve 272 is initially in its closed position blocking the housing bore 202.

The differential pressure responsive setting means 310 is initially releasably retained in its upper non-actuated position by the shear pins 470 and 472 connected between the lower sleeve 344 and the upper mandrel adapter 454 of the liner hanger means 38.

The ball valve actuating means 348 is initially releasably retained in its initial position corresponding to the closed position of ball valve 272 by the shear pins 418 and 420 connected between the lower power mandrel 362 and the housing 200.

The sliding sleeve bypass valve 510 is initially releasably retained in its open position by shear pins 520 and 522.

Thus, as the apparatus is lowered into the well, well fluid can flow up the spacer tubing 68, then radially outward through the port 504, annular cavity 506, and port 508 into the well annulus 24, then upward past the closed ball valve 272, then back in the port 67 of fill-up valve means 66 into the outer tubing string 34 so that the entire apparatus will move freely down into the well.

The liner hanger means 38 and the zone isolation packer 54 are of course initially in their retracted positions as seen in FIGS. 1A–1B.

The first and second sleeve valve means 42 and 56 are in their closed positions as illustrated in FIGS. 1A–1B.

The gravel packing apparatus 70 of operating string 32 has its upper and lower bypass valves 820 and 822 initially releasably locked in their open positions as schematically illustrated in FIG. 1B.

Of course, initially, the threaded connection 40 between the operating string 32 and the liner string 30 is made up so that they will be lowered together by the outer tubing string 34.

FIGS. 2A–2B

Setting The Liner Hanger

The liner string 30 is lowered as shown in FIGS. 1A–1B until the production screens 50 and 64 are located adjacent the subsurface formations 20 and 22 which are to be gravel-packed.

Figure 2B:
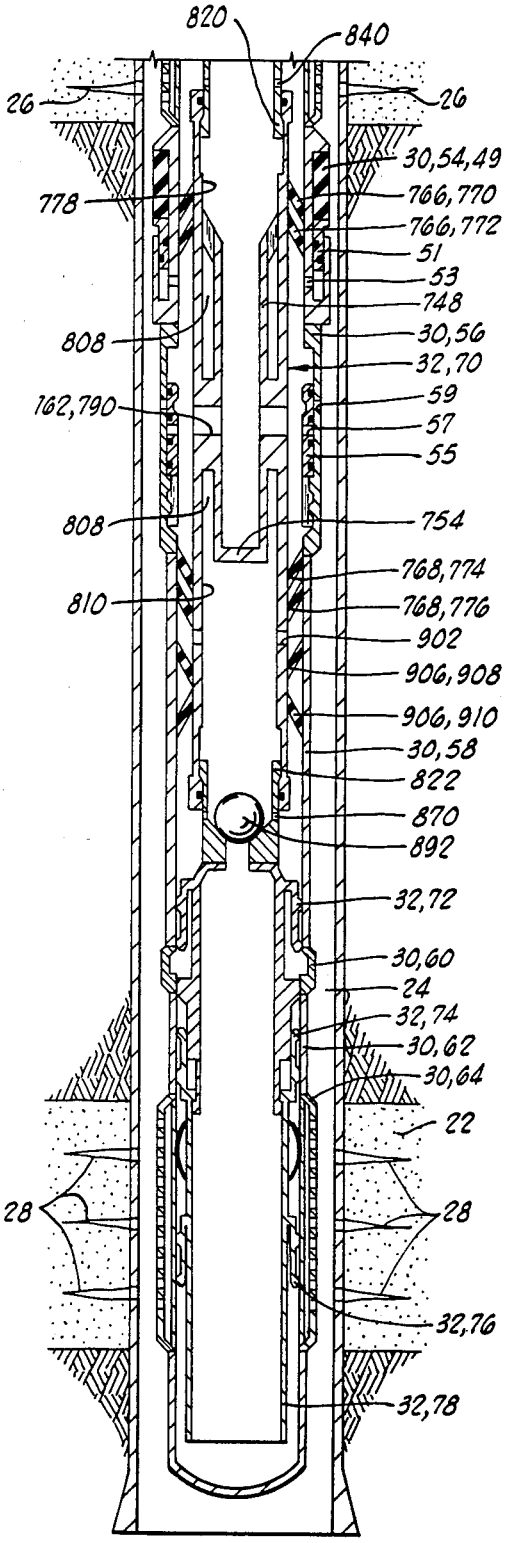

Then, as schematically illustrated in FIGS. 2A–2B, the liner hanger means 38 is set to fixedly hang the liner string 30 within the well bore 14.

This is accomplished as follows.

The fill-up valve means 66 is designed to close its port 67 at a predetermined hydrostatic pressure within the well bore 24. Thus, the port 67 will either close on its own at about the time the liner hanger means 38 reaches the desired elevation at which it will be set, or the port 67 can be closed by applying a relatively small increase in pressure to the well annulus 24.

Once the port 67 of fill-up valve means 66 is closed, any increase in pressure within the outer tubing string 34 above the closed ball valve 272 will be directed through tubing power port 328 into the power chamber 326.

When the downward pressure differential across power piston means 338 reaches a sufficient level, the differential pressure responsive setting means 310 will move downwardly relative to the housing 200 of liner hanger setting tool 36, and relative to the packer mandrel 446 of liner hanger 38 which is fixedly attached to the housing 200 at threaded connection 40, thus shearing the shear pins 470 and 472 and pushing the packer ring 480 downward relative to packer mandrel 446 thus setting the slips 482 and 484 of liner hanger means 38 and expanding the compressible sealing elements 448 thereof into sealing engagement with the well bore 14.

As the differential pressure responsive setting means 310 moves downward, it causes the sliding sleeve bypass valve 510 to be moved downward thus closing the lower bypass port 504 of liner hanger setting tool 36.

In a preferred embodiment of the present invention, the differential pressure responsive setting means 310 is constructed so that the shear pins 470 and 472 are sheared at a downward differential pressure of approximately 2,000 psi across the power piston means 338.

After the liner hanger means 38 has been set as illustrated in FIG. 2A, the seal of the sealing element 448 thereof against the well bore 414 must be tested.

This is accomplished by applying pressure to the well annulus 24 above the sealing element 448 greater than the formation pressure which exists in well annulus 24 below the sealing element 448. If there is a leak between the sealing element 448 and the well bore 14, it will not be possible to maintain annulus pressure within the well annulus 24 above the sealing element 448.

During this testing of the seal of sealing element 448, care must be taken not to exceed the opening pressure for the ball valve actuating means 348.

If a leak is detected between the sealing element 448 and the well bore 14, then additional pressure is placed within the bore of outer tubing string 34 so that the differential pressure responsive setting means 310 will exert additional downward force to further radially expand the sealing element 448 of the liner hanger 38.

During the test of the sealing element 448, if it is necessary to exert a pressure in the well annulus 24 above sealing element 448 greater than that which would normally actuate the ball valve actuating means 348, premature actuation of the ball valve actuating means 348 can be prevented by pressuring up both the bore of the outer tubing string 34 and the well annulus 24 simultaneously thus preventing a differential pressure across the differential pressure responsive ball valve actuating means 348.

FIGS. 3A-3B

Disconnecting the Operating String and Setting the Zone Isolation Packer

After the liner hanger means 38 has been set as just described with regard to FIGS. 2A-2B, the ball valve means 272 is opened by increasing pressure within the well annulus 24 above the sealing element 448, thus creating an upward pressure differential across the ball valve actuating means 348 and particularly across the power piston means 352 thereof to shear the shear pins 418 and 420 thus permitting the ball valve actuating means 310 to move upward within the housing 200 thus rotating the ball valve 272 from its closed position to an open position as schematically illustrated in FIG. 3A. This is done before the threaded connection 40 is disconnected between the liner hanger setting tool 36 and the liner hanger means 38.

In a preferred embodiment of the invention, the shear pins 418 and 420 are designed to shear when an upward pressure differential across power piston means 352 is in the range of 500 to 1,500 psi.

When the ball valve actuating means 348 moves upward within the housing 200 of liner hanger setting tool 38 to open the ball valve 272, it is locked in a final position corresponding to the open position of ball valve 272 by the locking dogs 430 and 432 which are received within the groove 442. It is subsequently not possible to reclose the ball valve means 272.

After the ball valve 272 is opened, it is desirable to again pressure-test the upper sealing element 448 by again applying pressure in the well annulus 24 above the sealing element 448. If there is a leak downward past the sealing element 448, the leak will this time be detected by fluid returns up through the outer tubing string 34. This occurs because the fluid flowing downward in well annulus 24 past the sealing element 448 will flow inward through the upper production screen means 50, then downward past the upper sealing cups 770 and 772, then in the treatment fluid passage mean 762, then up the inner bore of the stinger receptacle 748 and then up the bore of spacer tubing 68 through the open ball valve 272, then up the outer tubing string 34.

If, during the opening of the ball valve 272, a leak develops between the packing element 448 of liner hanger means 38 and the well bore 14, it is necessary to be able to close the housing bore 202 of liner hanger setting tool 36 once again so that additional setting force may be applied to the liner hanger means 38.

This can be accomplished by pumping down a ball 540 shown in phantom lines in FIG. 7B to seat on the annular seat 542 below the tubing power port 328. Then, additional setting force can be applied to the liner hanger means 38 by again increasing the pressure within the outer tubing string 34.

After that operation, it is necessary to reverse-circulate the ball 540 up out of the outer tubing string 34. The path of fluid for reverse-circulation is further described below with regard to the normal reverse-circulation procedure engaged in as illustrated in FIGS. 6A-6B, and it will be understood that a similar flow path can be utilized to reverse-circulate the ball 540 out of the outer tubing string 34 as must be done before the operations shown in FIGS. 5A-5B and 6A-6B may be accomplished.

Figure 3B:
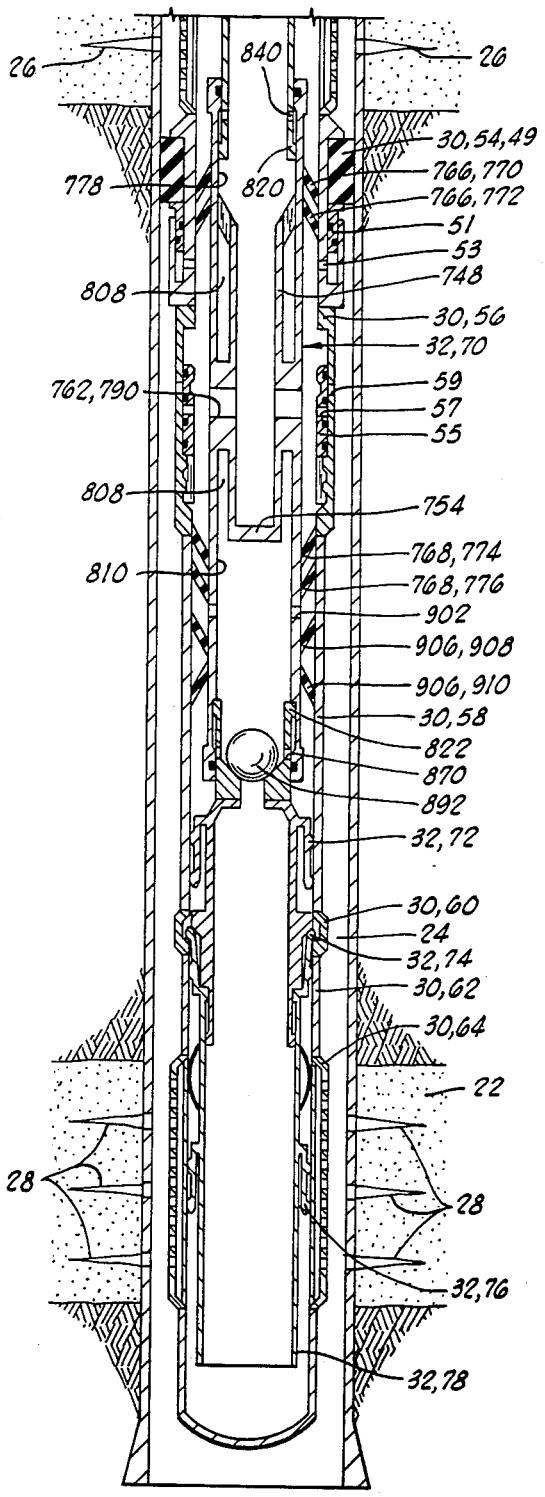

After the ball valve 272 has been opened, and it is determined that the sealing element 448 of liner hanger means 38 is securely sealed within the well bore 14, the outer tubing string 34 is rotated clockwise as viewed from above to disconnect the threaded connection 40 and thereby disconnect the operating string 32 from the liner string 30 as schematically illustrated in FIGS. 3A-3B. Of course, the liner string 30 is prevented from rotating due to the fixed engagement of sealing element 448 within the well bore 34.

After the threaded connection 40 is disconnected, the operating string 32 may be reciprocated within the liner string 32 to place the isolation gravel packer 70 and the other tools of the operating string 32 at appropriate locations to perform the remainder of the gravel-packing operation.

First, it is necessary to set the zone isolation packer 54. This is accomplished as schematically illustrated in FIG. 3B. The operating string 32 is pulled up, then set down to index the anchor positioner 74 and to positively lock it in position within the second anchor sub 60 as schematically illustrated in FIG. 3B, thus locating the isolation gravel packer 70 such that the first and second external seal means 766 and 768 thereof are located above and below the inflation ports 53 of first zone isolation packer 54.

Then, the upper and lower bypass valves 820 and 822 of zone isolation packer 70 are closed, and pressure is increased within the outer tubing string 34 and directed through the treatment fluid passage means 762 into the annular space between operating string 32 and liner string 30 through the setting port 53 thus forcing the compression piston 51 upward to expand the sealing element 49 of zone isolation packer 54 to seal it against the well bore 14 as schematically illustrated in FIG. 3B.

If the well included more than two production zones, then the liner string 30 would be constructed to include another set of tools including another zone isolation packer, another three-position sliding sleeve valve, another polished bore sub, another anchor sub, and another production screen means.

Typically, each of the zone isolation packers would be set prior to conducting any other operations on the liner string 30, although zone isolation packers may be set and zones gravel-packed in any logical sequence.

FIGS. 4A-4B

Testing The Zone Isolation Packer

Figure 4A:
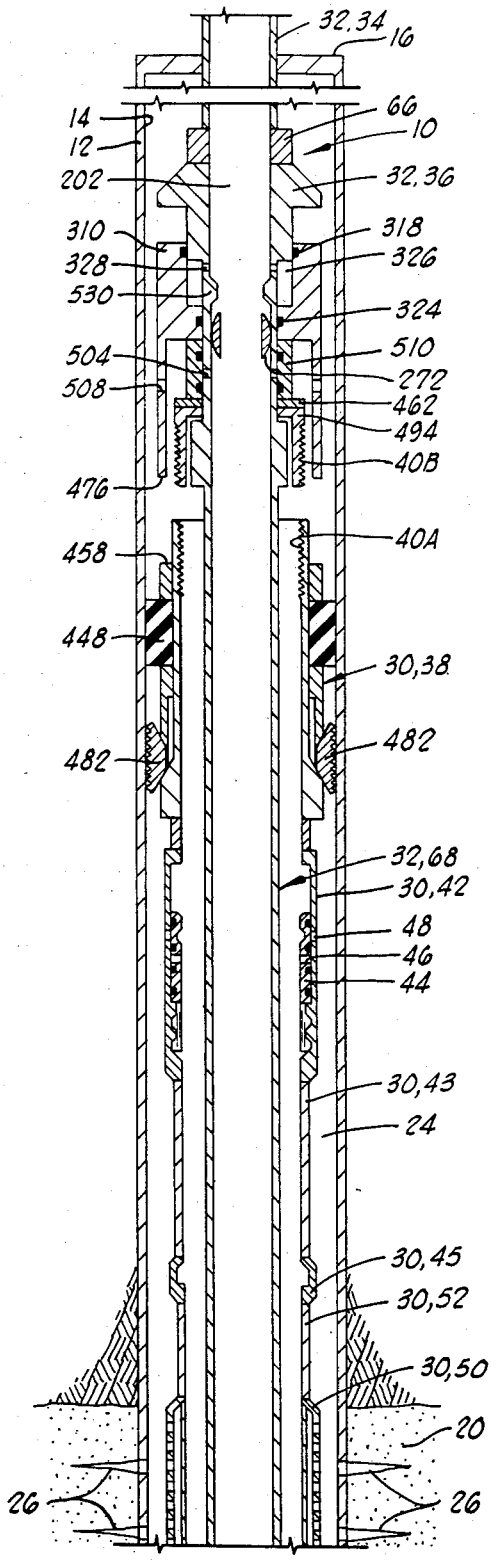
FIGS. 4A–4B are similar to FIGS. 1A–1B and show the gravel-packing system of the present invention in position to test a zone isolation packer which has previously been set. Also, the sliding sleeve valve below the isolation packer has been moved to its open position.

After the zone isolation packer has been set as just described, the operating string 32 is picked up until the opening positioner 72 engages the sleeve 55 of sleeve valve means 56 and pulls it up to an open position wherein ports 57 and 59 are aligned as schematically illustrated in FIG. 4A.

Figure 4B:
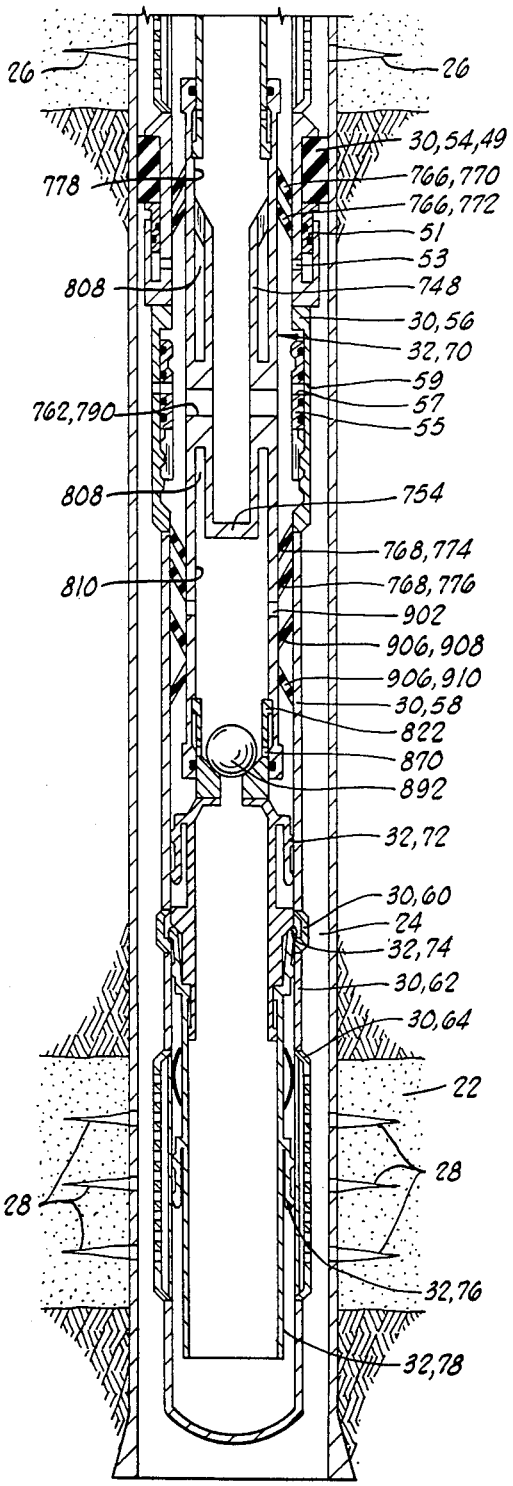

Then, the operating string 32 is again lowered to push the anchor positioner 74 downward through the anchor sub 60, and then the operating string 32 is picked back up through the anchor sub 60 and once again set back down to anchor the anchor positioner 74 within the anchor sub 60 as schematically illustrated in FIG. 4B.

These motions of the anchor positioner 74 are accomplished through an indexing system, which as previously mentioned is described in detail in U.S. Pat. No. 4,369,840 to Szarka et al.

With the operating string 32 oriented as illustrated in FIGS. 4A-4B, and with the second sleeve valve means 56 in its open position as illustrated in FIG. 4B, the seal of the sealing element 49 of zone isolation packer 54 within the well bore 14 can be tested by increasing pressure within the outer tubing string 34 which is conveyed through the treatment fluid passage 762, then through the open ports 57 and 59 of sleeve valve means 56 into the well annulus 24 below the expanded sealing element 49 of zone isolation packer 54.

If there is a leak between the sealing element 49 and the well bore 14, fluid will flow upward from the well annulus 24 between the sealing element 49 and the well bore 14, then in through the first production screen means 50 and up between the open annulus between the operating string 32 and the liner string 30, then into the open well annulus 24 above the liner hanger means 38 which can be detected at the surface.

If it is determined that there is a leak past the zone isolation packer 54, then the operating string 32 is appropriately manipulated to return it to the position schematically illustrated in FIGS. 3A–3B and setting pressure is again directed to the setting ports 53 of the zone isolation packer 54.

Subsequently, the operating string 32 is again manipulated as previously described to return it to the testing position of FIGS. 4A–4B, to determine that the sealing element 49 of zone isolation packer 54 is now properly sealed within the well bore 14.

In a system designed for more than two production zones of a well, the zone isolation packers between adjacent production zones can be set and tested in any order, but normally this is done beginning with the lowermost zone isolation packer and working up, since the operating string is initially fully inserted within the liner string 30 when the threaded connection 40 is first disconnected.

FIGS. 5A–5B

The Gravel-Packing Operation

After the zone isolation packer 54 is properly inflated, the liner string 30 is now appropriately oriented to begin the gravel-packing operation.

The operating string 32 remains with the anchor positioner 74 engaged with the lower anchor sub 60, and the concentric inner tubing string 760 is run down through the outer pipe string 34, and through the ball valve bore 444, and its lower stinger 758 is stabbed into seal bore 756 of stinger receptacle 748 as illustrated in detail in FIGS. 9A–9H. The stinger 758 is guided into seal bore 756 by guide surface 780.

Then, a gravel laden slurry is pumped down from surface location 16 down through the concentric inner tubing string 760, into the stinger receptacle 748, through the gravel laden slurry passage means 762, then through the open ports 57 and 59 of the sleeve valve means 55, into the well annulus 24 adjacent the subsurface production zone 22 which is to be gravel-packed.

The gravel from the gravel laden slurry will collect in the well annulus 24 and build up from the lower end 18 of the well until it reaches an elevation above the upper end of the second production screen means 64, at which point an increase in required pumping pressure will be detected at the surface, thus indicating that the gravel-packing operation is completed.

The gravel will collect as indicated at 13 in FIG. 5B, and the carrier fluid from the gravel laden slurry will enter the lower production screen means 64, then flow up through the open lower end of the tail pipe 78, then up past the one-way check valve 892 into the lower housing bore 810 of isolation gravel packer 70, then through the longitudinal bypass passage 808 of isolation gravel packer 70 which also serves as a portion of the return path, then through the annular space defined between the various portions of the operating string 32 and the concentric inner tubing string 760 below the ball valve 272, then through an annular space 912 between the ball valve bore 444 and the concentric inner tubing string, then up through a tubing annulus 914 between the outer pipe string 34 and the concentric inner tubing string 760 back to the surface location 16.

As mentioned, this flow is continued until the gravel 13 reaches a level above the upper end of the lower production screen means 64.

After the gravel is completely in place, the gravel pack may be squeezed by closing in the drill pipe/tubing annulus 914 and applying pressure to the bore of inner concentric tubing string 760. This will cause gravel to be forced out into the perforations 26 and will consolidate the gravel pack.

FIGS. 6A–6B

The Reversing-Out Procedure

After the gravel pack has been placed, and squeezed if desired, it is necessary to remove excess gravel laden slurry from the operating string 32 and the concentric inner tubing string 760.

This is accomplished as shown schematically in FIGS. 6A–6B by reversing the direction of fluid flow and pumping clean fluid down the drill pipe/tubing annulus 914, then through the annular space 912 between ball valve bore 444 and concentric inner tubing string 760, then down through the annular space between concentric inner tubing string 760 and operating string 32, then down through the longitudinal bypass passage 808 of isolation gravel packer 70, then out through the reverse-circulation passage 902, then upward past the one-way sealing cups 774 and 776, then back in the treatment fluid passage means 762, then up through the bore of concentric inner tubing string 760 back to the surface location 16.

The one-way check valve 892 remains closed during the reverse-circulation procedure.

It is noted that neither return fluid nor reverse-circulation fluid ever flows past the upper production screen means 50 and the unconsolidated upper producing zone 20. This is very important because many prior art systems do permit such flow immediately past unconsolidated zones, which flow can disrupt the unconsolidated zone due to turbulence created by the fluid flow.

With the system of the present invention, all flow paths for placing slurry, for return fluid, and during reverse-circulation, are contained primarily within the concentric inner tubing string 760 and the tubing annulus 914 between the outer pipe string 34 and the concentric inner tubing string 760.

Also, it is noted that the reverse-circulation path covers substantially all areas which contain slurry, thus completely flushing the slurry out of the operating string 32 and from the annular space between operating string 32 and liner string 30.

After the reversing out procedure schematically illustrated in FIGS. 6A–6B is completed, the operating string 32 is picked up until the closing positioner 76 engages the sleeve 55 of sleeve valve means 56 and pulls it upward to an uppermost position wherein the port 57 is located above the port 59 with a seal therebetween so as to again close the sleeve valve means 56.

The operating string 32 continues to be moved upward until its opening positioner 72 engages the sleeve 44 of the first sleeve valve means 42, and moves it to an open position such that ports 46 and 48 are aligned.

Then, the anchor positioner 74 is locked in the upper anchor sub 48 and the upper production zone 70 can then be gravel-packed in a manner similar to that just described for the lower production zone.

SUMMARY OF ADVANTAGES

The system just described provides a number of advantages over prior art systems, many of which have already been mentioned.

One primary advantage previously mentioned is that the rotatable ball valve 272 generally eliminates the need for use of pump-down balls to actuate the liner hanger setting tool.

Additionally, the use of the concentric inner tubing string for conducting gravel laden slurry down into the well provides a significant advantage in that the cross-sectional area for flow of the slurry is reduced, thus increasing the velocity of the slurry for a given pump rate. Thus, in deviated well bores, there is less settling out of gravel within the various tubing strings themselves. This means an increase in volumetric efficiency of gravel placement and a decreased possibility of gravel bridging within the tubing string due to "slugging" of settled-out gravel.

Additionally, the system of the present invention as compared, for example, to the system previously used by the assignee of the present invention as shown in U.S. Pat. No. 4,273,190 to Baker et al., eliminates the need for a crossover tool at the top of the operating string, thus eliminating the many problems associated with such crossover tools.

The fact that the concentric inner tubing string is totally independent of the outer drill pipe string and the operating string thus makes the construction for the isolation gravel packer 70 less complicated, thus simplifying the manufacture and maintenance thereof.

The isolation gravel packer 70 of the present invention generally provides a larger bypass area than provided with most prior art apparatus.

Additionally, the design of the isolation gravel packer 70 permits the spacing between the first and second seal means 766 and 768 to be easily varied by the incorporation of a threaded spacer tubing member therebetween.

Furthermore, with the present system, the zone isolation packers such as 54 can be easily set and tested before running the concentric inner tubing string 760.

Thus it is seen that the apparatus and methods of the present invention readily achieve the ends and advantages mentioned as well as those inherent therein. While certain preferred embodiments of the present invention have been illustrated for the purposes of the present disclosure, numerous changes in the arrangement and construction of parts and steps may be made by those skilled in the art, which changes are embodied within the scope and spirit of the present invention as defined by the appended claims.

What is claimed is:

1. A well treatment apparatus comprising:
a housing means;
a stinger receptacle disposed in said housing means, said stinger receptacle including:
an open upper end; and
an inner cylindrical seal bore for sealingly receiving a concentric inner tubing string means for delivering a treatment fluid;
treatment fluid passage means disposed laterally through said housing means for communicating an interior of said stinger receptacle at an elevation below said seal bore with a well zone to be treated;
first and second external seal means, disposed on an exterior of said housing means above and below said treatment fluid passage means, respectively, for sealing between said housing means and a liner bore; and
bypass means, disposed in said housing means, for bypassing well fluid around said first and second external seal means as said apparatus is moved longitudinally within a well.

2. The apparatus of claim 1, wherein:
said seal bore is of reduced internal diameter as compared to an upper housing bore above said seal bore.

3. The apparatus of claim 1, further comprising:
an upwardly facing, conically tapered, radially inner guide surface located above said open upper end of said stinger receptacle for guiding a lower stinger of said concentric inner tubing string means into said seal bore.

4. The apparatus of claim 3, wherein:
said upwardly, facing conically tapered surface is further characterized as a means for engaging a complementary downwardly facing, conically tapered, radially outer surface of said concentric inner tubing string means to thereby define a fully inserted position of said stinger within said seal bore.

5. The apparatus of claim 1, in combination with said concentric inner tubing string means, wherein:
said concentric inner tubing string means includes a lower stinger closely received in said seal bore; and
further comprising stinger seal means for sealing between said stinger and said seal bore.

6. The combination of claim 5, wherein:
said treatment apparatus further comprises an upwardly facing, conically tapered, radially inner guide surface located above said open upper end of said seal bore; and
said stinger includes a complementary downwardly facing, conically tapered, radially outer surface abutting said guide surface when said stinger is fully inserted in said seal bore.

7. The apparatus of claim 1, wherein:
said stinger receptacle further includes a closed lower end; and
said bypass means includes a longitudinal bypass passage disposed in said housing means and communicating said upper housing bore above said seal bore with a lower housing bore below said closed lower end of said stinger receptacle, said longitudinal bypass passage being isolated from said treatment fluid passage means when said concentric inner tubing string is received in said seal bore.

8. The apparatus of claim 7, wherein:
said longitudinal bypass passage also defines a portion of a return fluid path for returned treatment fluid.

9. The apparatus of claim 7, further comprising:
reverse circulation passage means disposed laterally through said housing means for communicating said lower housing bore below said closed lower end of said stinger receptacle with an exterior portion of said housing means below said second external seal means; and wherein said second external seal means is further characterized as a one-way seal means for preventing flow of treatment fluid from said treatment fluid passage means downward between said housing means and said liner bore to said reverse circulation passage means, and for permitting flow of reverse circulation fluid from said reverse circulation passage means upward between said housing means and said liner bore and then into said treatment fluid passage means.

10. The apparatus of claim 7, wherein said bypass means further comprises:

an upper lateral bypass passage disposed through said housing means for communicating said upper housing bore with an upper exterior portion of said housing means above said first external seal means; and a lower lateral bypass passage disposed through said housing means for communicating said lower housing bore with a lower exterior portion of said housing means below said second external seal means, so that as said apparatus is lowered into said well, well fluid can bypass said first and second external seal means by flowing in said lower lateral bypass passage, up said lower housing bore, up through said longitudinal bypass passage, up said upper housing bore, and out said upper lateral bypass passage.

11. The apparatus of claim 10, further comprising:

upper and lower bypass valve means for selectively closing and opening said upper and lower lateral bypass passages, respectively.

12. The apparatus of claim 11, wherein:

said upper and lower bypass valve means are each further characterized as being sliding sleeve type bypass valve means constructed to be closed when a compression loading is applied longitudinally across said apparatus, and to be opened when a tension loading is applied longitudinally across said apparatus.

13. The apparatus of claim 12, wherein:

each of said upper and lower bypass valve means includes releasable locking means for releasably locking said upper and lower bypass valve means in their open positions wherein said upper and lower lateral bypass passages are open.

14. A well treatment apparatus, comprising:

a housing means, including:

an upper housing bore extending downward from an open upper end of said housing means;

a reduced diameter seal bore located below said upper housing bore, said seal bore having an open upper end and a closed lower end;

a lower housing bore located below said closed lower end of said seal bore and extending to an open lower end of said housing means;

a longitudinal bypass fluid and return fluid passage means communicating said upper and lower housing bores;

an upper lateral bypass passage means for communicating said upper housing bore with an exterior of said housing means;

a treatment fluid passage means for communicating said seal bore with said exterior of said housing means;

a reverse circulation passage means for communicating said lower housing bore with said exterior of said housing means; and a lower lateral bypass passage means, located below said reverse circulation passage means, for communicating said lower housing bore with said exterior of said housing means;

first external seal means disposed on said exterior of said housing means between said upper lateral bypass passage means and said treatment fluid passage means;

second external seal means disposed on said exterior of said housing means between said treatment fluid passage means and said reverse circulation passage means, said second external seal means being a one-way seal means for preventing downward flow and for allowing upward flow therepast; and third external seal means disposed on said exterior of said housing means between said reverse circulation passage means and said lower lateral bypass passage means.

15. The apparatus of claim 14, further comprising:

an upper sliding sleeve bypass valve telescopingly connected to said upper end of said housing means for selectively opening and closing said upper lateral bypass passage means;

a lower sliding sleeve bypass valve telescopingly connected to said lower end of said housing means for selectively opening and closing said lower lateral bypass passage means;

said upper and lower sliding sleeve bypass valves being arranged and constructed to be closed when a compressional loading is applied longitudinally across said apparatus, and to be opened when a tension loading is applied longitudinally across said apparatus; and wherein each of said upper and lower bypass valves include releasable locking means for releasably locking said valves in their open positions until a predetermined level of compressional loading is applied longitudinally across said apparatus.

16. The apparatus of claim 14, further comprising:

one-way check valve means, operably associated with said open lower end of said housing means, for preventing downward flow of fluid through said open lower end of said housing means.

17. A method of treating a well, said method comprising the steps of:

(a) making up on a lower end of an outer tubing string a tool string including a well treatment apparatus, said well treatment apparatus including a stinger receptacle, a treatment fluid passage means for communicating said stinger receptacle with a well zone to be treated, and a return fluid passage means isolated from said treatment fluid passage means and communicated with an inner bore of said outer tubing string;

(b) lowering said outer tubing string into said well until said well treatment apparatus is appropriately located for treatment of said well zone;

(c) lowering a concentric inner tubing string into said outer tubing string;

(d) stabbing a lower stinger of said concentric inner tubing string into said stinger receptacle;

(e) flowing well treatment fluid from a surface location down through said concentric inner tubing string, then through said treatment fluid passage means to said well zone; and (f) during step (e), flowing a return fluid from said well zone upward through said return fluid passage means of said well treatment apparatus, then up through an annulus between said outer tubing string and said concentric inner tubing string to said surface location.

18. The method of claim 17, wherein:

said step (a) is further characterized in that said well treatment apparatus includes upper and lower external seals disposed on an exterior of a housing of said apparatus above and below said treatment fluid passage means, respectively; and said method further includes a step of bypassing well fluid around said upper and lower external seals through said return fluid passage means of said well treatment apparatus upon longitudinal movement of said well treatment apparatus within said well.

19. The method of claim 18, wherein:

said step (a) is further characterized in that said well treatment apparatus includes a reverse circulation passage which communicates said return fluid passage means with said exterior of said housing below said lower external seal, and said lower external seal is a one-way seal preventing downward flow therepast and permitting upward flow therepast;

said method further comprises the step of:

after steps (e) and (f) have been completed, reversing a direction of circulation and flowing clean fluid from said surface location down said annulus between said outer tubing string and said concentric inner tubing string, down through said return fluid passage means of said treatment apparatus, out said reverse circulation passage, up past said one-way lower external seal, in said treatment fluid passage means of said treatment apparatus into said stinger receptacle, then up through said concentric inner tubing string, to thereby reverse-circulate any remaining treatment fluid out of said well treatment apparatus and said concentric inner tubing string.

* * * * *